US008501301B2

(12) United States Patent
Okuda et al.

(10) Patent No.: US 8,501,301 B2
(45) Date of Patent: Aug. 6, 2013

(54) MAGNESIUM ALLOY MEMBER AND METHOD OF MANUFACTURING THE SAME

(75) Inventors: Nobuyuki Okuda, Osaka (JP); Masatoshi Majima, Osaka (JP); Shoichiro Sakai, Osaka (JP); Shinji Inazawa, Osaka (JP); Nobuyuki Mori, Osaka (JP); Ryuichi Inoue, Osaka (JP); Yukihiro Oishi, Osaka (JP); Nozomu Kawabe, Osaka (JP); Masatada Numano, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 588 days.

(21) Appl. No.: 12/377,916

(22) PCT Filed: Jul. 10, 2007

(86) PCT No.: PCT/JP2007/000751

§ 371 (c)(1),
(2), (4) Date: Feb. 18, 2009

(87) PCT Pub. No.: WO2008/029497

PCT Pub. Date: Mar. 13, 2008

(65) Prior Publication Data

US 2011/0217514 A1 Sep. 8, 2011

(30) Foreign Application Priority Data

Sep. 8, 2006 (JP) ..... P. 2006-244887
Sep. 27, 2006 (JP) ..... P. 2006-263645

(51) Int. Cl.

| | |
|---|---|
| ***B32B 3/00*** | (2006.01) |
| ***B05D 3/12*** | (2006.01) |
| ***B05D 1/36*** | (2006.01) |
| ***B22D 25/00*** | (2006.01) |
| ***C25D 7/00*** | (2006.01) |

(52) U.S. Cl.
USPC ..... 428/142; 428/472.2; 427/292; 164/76.1; 205/50

(58) Field of Classification Search
None
See application file for complete search history.

(56) References Cited

U.S. PATENT DOCUMENTS

| | | | | |
|---|---|---|---|---|
| 4,540,449 | A * | 9/1985 | Yoshida et al. | 428/472.2 |
| 4,702,885 | A * | 10/1987 | Odani et al. | 419/23 |
| 5,700,424 | A * | 12/1997 | Matsuo et al. | 266/108 |
| 5,874,175 | A * | 2/1999 | Li | 428/457 |
| 6,143,371 | A * | 11/2000 | Suzuoki et al. | 427/430.1 |
| 6,180,162 | B1 | 1/2001 | Shigeru et al. | |
| 6,929,705 | B2 * | 8/2005 | Myers et al. | 148/243 |
| 7,841,380 | B2 * | 11/2010 | Numano et al. | 164/459 |
| 2003/0213771 | A1 | 11/2003 | Ohshita et al. | |
| 2006/0249393 | A1 * | 11/2006 | Ghosh et al. | 205/639 |
| 2009/0087681 | A1 * | 4/2009 | Decker et al. | 428/649 |
| 2011/0033332 | A1 * | 2/2011 | Numano et al. | 420/402 |

FOREIGN PATENT DOCUMENTS

| | | | |
|---|---|---|---|
| CN | 1243550 | A | 2/2000 |
| JP | 2001-049493 | | 2/2001 |
| JP | 2001-073194 | | 3/2001 |
| JP | 2001-288580 | | 10/2001 |
| JP | 2003-055795 | | 2/2003 |
| JP | 2005-002378 | | 1/2005 |
| JP | 2005-120212 | | 5/2005 |
| JP | 2005-248204 | | 9/2005 |
| JP | 2005-281717 | | 10/2005 |
| JP | 2005281717 | * | 10/2005 |
| WO | WO 2006/003899 | A1 | 1/2006 |

OTHER PUBLICATIONS

Fuji et al. Materials Science Forum vols. 412-422, 2003, pp. 109-114.*

The Great Soviet Encyclopedia, 1979, p. 1-4.*

Chinese Office Action, w/ English translation thereof, issued in Chinese Patent Application No. CN 200780033349.3 dated Mar. 11, 2010.

Russian Office Action, with English Translation, issued in Russian Patent Application No. 2009113020/02(017722) dated Jun. 24, 2010.

Shvedkov, E.L. et al., Handbook Dictionary on Powder Metallurgy, Kiev, Naukova Dumka,: 1982, p. 110.

* cited by examiner

*Primary Examiner* — Vera Katz

(74) *Attorney, Agent, or Firm* — McDermott Will & Emery LLP

(57) ABSTRACT

A magnesium alloy member having mechanical properties and corrosion resistance and a method of manufacturing the magnesium alloy member are provided. A magnesium alloy member has a base material made of a magnesium alloy, and an anticorrosive film formed on the base material. The base material is a rolled magnesium alloy including 5 to 11% by mass of Al. By using a base material including a large amount of Al, a magnesium alloy member having excellent mechanical properties and high corrosion resistance can be produced. In addition, by using a rolled material, the number of surface defects at the time of casting is small, and the frequency of compensation processes such as undercoating and puttying can be reduced.

30 Claims, 1 Drawing Sheet

100.00μm/div
MAGNIFICATION RATIO: x 100

100.00μm/div
MAGNIFICATION RATIO: x 100

MAGNESIUM ALLOY MEMBER AND METHOD OF MANUFACTURING THE SAME

RELATED APPLICATIONS

This application is the U.S. National Phase under 35 U.S.C. §371 of International Application No. PCT/JP2007/000751, filed on Jul. 10, 2007, which in turn claims the benefit of Japanese Application No. 2006-244887 and Japanese Application No. 2006-263645, filed on Sep. 8, 2006 and Sep. 27, 2006 respectively, the disclosures of which Applications are incorporated by reference herein.

TECHNICAL FIELD

The present invention relates to a magnesium alloy member and a method of manufacturing the magnesium alloy member, and more particularly, to a magnesium alloy member in which a surface treatment such as formation of anticorrosive film or paint application is performed on a surface of a magnesium alloy plate.

BACKGROUND ART

Magnesium is known as the lightest metal among metal materials used for structures, and has a specific gravity of 1.74 (density g/cm$^3$, 20° C.). The magnesium can have a higher strength by adding a variety of elements and alloying them. Accordingly, the recently magnesium alloy can be used as housing for small portable machines such as cellular phones or mobile machines, housing for notebook computers, or components for automobiles, etc. Particularly, the magnesium alloy including a large amount of aluminum (for example, ASTM American Standard for Testing and Materials: AZ91) has a high corrosion resistance or a strength, and thus a great demand for the magnesium alloy is expected.

However, since the magnesium alloy has a hcp structure (hexagonal close-packed structure) which is poor in plastic processability, the magnesium alloy products used as the above-mentioned housing are mainly cast materials produced by a die casting or thixo molding method. As other magnesium alloys, for example, AZ31 that is relatively easily subjected to a plasticity process is used for housing by rolling an ingot-cast cast material for producing a plate and subsequently press-molding the plate (see Patent Literature 1, as an analogous technique).

Patent Literature 1: Japanese Patent Unexamined Publication JP-A-2005-2378

DISCLOSURE OF THE INVENTION

Problem to be Solved by the Invention

However, the cast material has a problem in that the surface treatment for the cast material is so complicated. Generally, magnesium alloy plates for housing are subjected to a surface treatment so as to improve corrosion resistance and a quality of appearance. This surface treatment is divided into a surface-preparation treatment and a paint application treatment. In the surface-preparation treatment, the above cast material or a press-formed plate is used as a treatment object. The treatment object is subjected to a degreasing treatment, acid etching treatment, desmutting treatment, surface adjustment, and chemical treatment or anodizing treatment. In the paint application treatment, the treatment object subjected to the surface-preparation treatment is subjected to an undercoating treatment, puttying, polishing, and an overcoating treatment.

The cast material has many surface defects, and thus it is necessary to repeat the puttying process of filling the surface defects with the putty and the polishing process more than once after the undercoating treatment. As a result, yield of the surface treatment is very low, and for this reason, a manufacturing cost for products increases. In addition, the cast material has problems in that the mechanical properties thereof, such as a tensile strength, ductility and toughness, are smaller than those of the molded plate subjected to a rolling process.

Further, the molded plate of AZ31 has problems in that the corrosion resistance of its material and the adhesion of the film formed by the surface treatment are low. AZ31 is more easily formed than AZ91. When AZ31 is used for producing a plate by the rolling process, the resultant plate has more excellent characteristics than those of the cast material and it is possible to reduce the surface defects. Accordingly, the low yield in the surface treatment, that is the problem of the cast material, can be improved. However, AZ31 has lower corrosion resistance than those of AZ91 and the like, and thus it is difficult to satisfy required characteristics. Considering the improvement of the corrosion resistance only, for an example, a chemical conversion treatment film may be thickly formed by the surface-preparation treatment. However, the chemical conversion treatment film can not be formed with high adhesion on the molded plate of AZ31, and surface resistance of the film increases even if the film is thickly formed. When a magnesium alloy is used for housing for electronic equipments such as cellular phones, characteristics including grounding, removing of a high-frequency current and electromagnetic shielding are required to the housing. Accordingly, it is desirable to lower the surface resistance of the chemical conversion treatment film as much as possible. Thus, the formation of a thick chemical conversion treatment film on the molded plate of AZ31 is rarely considered for improving the corrosion resistance.

SUMMARY OF THE INVENTION

The invention aims to solve the above-mentioned problems, and an object of the invention is to provide a magnesium alloy member having mechanical properties and corrosion resistance and a method of manufacturing the magnesium alloy member.

Another object of the invention is to provide a magnesium alloy member which can be improved in a surface treatment yield and a method of manufacturing the magnesium alloy member.

Means to Solve the Problem

According to an aspect of the invention, a magnesium alloy member has a base material made of a magnesium alloy and an anticorrosive film formed on the base material. The base material is a rolled magnesium alloy including 5 to 11% by mass of Al.

Thanks to the above structure, by using a base material including a large amount of Al, a magnesium alloy member having excellent mechanical properties and high corrosion resistance can be produced. In addition, by using a rolled material, the number of surface defects at the time of casting is small, and the frequency of compensation processes such as undercoating treatment and puttying can be reduced in the case of performing subsequent paint application treatments. The rolled material is a member subjected to a rolling process, and may be additionally subjected to other process such as a leveling process or a polishing process.

According to the aspect of the invention, it is preferable that the magnesium alloy member has a shear-processed portion.

Thanks to this structure, it is possible to produce a magnesium alloy member having a predetermined geometry, high corrosion resistance and excellent mechanical properties. In the magnesium alloy member, the shear-processed portion is a portion to which a shearing process such as cutting or punching is performed. Typically, a cut (punching) end face of a magnesium plate piece having a predetermined geometry which is obtained by performing the shearing process to a long rolled plate is used as the shear-processed portion.

According to the aspect of the invention, it is preferable that the magnesium alloy member having the shear-processed portion has a plasticity-processed portion additionally.

Thanks to this structure, it is possible to produce a magnesium alloy member having a predetermined geometry, high corrosion resistance and excellent mechanical properties. Particularly, it is possible to produce a magnesium alloy member having a three-dimensional shape. In the magnesium alloy member, the plasticity-processed portion is a portion to which a plasticity process is performed. The plasticity process can be exemplified by at least one of a pressing process, a deep-drawing process, a forging process, a blowing process, and a bending process. Magnesium alloy members of various types can be obtained by the plasticity process. A base material subjected to the pressing process is particularly suitable for forming housing for electronic equipments.

In addition, according to the magnesium alloy of the invention, it is preferable that the base material satisfies the following requirements:

(1) an average crystal grain size is 30 μm or less;

(2) intermetallic compounds have a size of 20 μm or less; and (3) depth of a surface defect is 10% or less of a thickness of the base material.

By controlling the average crystal grain size of the magnesium alloy constituting the base material to 30 μm or less, coarse particles acting as starting points of cracking are removed, and thus it is possible to improve plastic processability. When the average crystal grain size of the magnesium alloy is small, grain boundaries more tends to act as resistance disturbing movement of electrons in comparison with the case in which the diameter is large. Accordingly, the movement of electrons in a surface portion of the base material is suppressed, resulting in an increase of corrosion resistance. The average crystal grain size of the magnesium alloy is preferably 20 μm or less, more particularly 10 μm or less, and even more particularly 5 μm or less. The average crystal grain sizes is obtained by average values which are calculated by cutting the base material at a surface portion and a central portion, and the respective grain diameters are calculated by the method defined in JIS (Japanese Industrial Standard) G 0551 (2005). The surface portion of the base material is an area defined from the surface to 20% of a thickness of the base material in a thickness direction of a cross-section of the base material, and the center portion is an area defined from the center to 10% of a thickness of the base material in the thickness direction of a cross-section of the base material. The average crystal grain size can vary by controlling rolling conditions (e.g., total rolling reduction and temperature) or conditions for heat treatment (e.g., temperature and period of time) after the rolling in producing the base material. When the shearing process or plasticity process is performed to a material member (rolled material), the grain diameters in the vicinity of the processed portion may vary. Accordingly, the average crystal grain size of the base material of the magnesium alloy member is preferably obtained from non-processed portions other than portions including vicinities of the shear-processed portion and plasticity-processed portion.

When the intermetallic compounds of the base material has a size of 20 μm or less, it is possible to improve the processability at the time of performing the plasticity process including the pressing process to the material member. The coarse intermetallic compounds having a size larger than 20 μm act as starting points of cracking at the time of plasticity process. The intermetallic compounds preferably have a size of 10 μm or less. Generally, such a base material can be obtained from a cast material. A cooling rate for solidification at the time of casting is adjusted in the range of 50 K/sec to 10,000 K/sec so as to control the sizes of the intermetallic compounds of the base material to 20 μm or less. By these manners, it is possible to obtain a cast material having small intermetallic compounds. Particularly, it is preferable to equalize the cooling rate in a width direction and length direction of the cast material. In addition to the control of the cooling rate, it is more effective that a molten material is stirred in a melting furnace or a tundish. At this time, the temperature of the molten material is preferably controlled so as not to be below a temperature that intermetallic compounds are partially generated. The size of the intermetallic compound is set by observing a cross-section of the base material with a metal microscope and obtaining a length of the longest one of cutting lines of the intermetallic compounds in the cross-section. In addition, a plurality of cross-sections are randomly taken, the sizes of the intermetallic compounds in the cross-sections are arbitrary obtained, and then the largest one of the sizes of the intermetallic compounds in the twenty cross-sections is employed as the size of the intermetallic compound.

Particularly, it is preferable to control the sizes of the intermetallic compounds present on the surface of the base material to 5 μm or less. The intermetallic compounds on the surface of the base material have a great effect on a quality of a surface treatment layer including an anticorrosive film and a painting film. For this reason, it is possible to reduce the effect on the quality of the surface treatment layer as much as possible when the sizes of the intermetallic compounds are 5 μm or less. The diameters of the intermetallic compounds on the surface is set by observing the surface of the base material with a microscope of 1000 times or more power and obtaining a length of the longest one of cutting lines of the intermetallic compounds present on the surface of the base material. In addition, the largest one of the sizes of the intermetallic compounds in twenty fields is employed as the diameter of the intermetallic compound on the surface of the base material. In order to reduce the sizes of the intermetallic compounds on the surface of the base material, a molten material always comes into contact with a casting mold at the time of solidification of a cast material, such that rapid cooling is performed at a speed of 400 K/sec or more. The molten material always comes into contact with the casting mold by, for example, reducing an interval between a nozzle for supplying the molten material to the casting mold and rolls (casting mold) in twin roll casting.

Further, by controlling the depths of the surface defects to 10% or less of a thickness of the base material, the surface defects rarely act as starting points of cracking in the case in which a folding process is performed in the pressing process, and thus processability can be improved. When the depths of the surface defects are shallow, a polishing amount in the polishing process for smoothing a surface of the rolled material is reduced. Thus, it is effective to lower a manufacturing cost for products. Such base material can be obtained by using a cast material having a small number of surface defects. The depths of the surface defects are controlled to less than 10% of a thickness of the cast material by, for example, lowering a temperature of a molten material and increasing a cooling rate. At the time of casting, a movable casting mold with a metal coated layer having excellent heat conductance and wettability of a molten material to the movable casting mold may be used, or a variation in a temperature of the molten material in a width direction of a cross-section of a molten material injection port may be controlled to 10° C. or less. The depths of the surface defects of the base material are preferably 3% or less of a thickness of the base material, and more preferably 1% or less of a thickness of the base material. Two points are arbitrary selected in an area having a length of 1 m in a length direction of a plate, and then cross-sections at the two points are taken to polish a total of 4 cross-sections by using an emery paper of #4000 or less and by using particles for polishing a diamond having a particle diameter of 1 μm. Then, an entire periphery of each cross-section is observed using a metal microscope of 200 times power, and the largest one of the depths of the identified surface defects is employed as the depth of the surface defect.

In addition, it is preferable that the lengths of the surface defects of the base material are controlled to 20 μm or less. When the lengths of the surface defects are 20 μm or less, the surface defects rarely act as starting points of cracking at the time of performing the plasticity process. Accordingly, processability can be improved and a polishing amount of the surface of the rolled material can be reduced.

In order to obtain the length of the surface defect, a defect portion is specified using "liquid penetrant test" according to JIS Z 2343, also called "red check". In the liquid penetrant test, a stain having good permeability is applied to a cleaned object to be detected, and then is cleaned by a cleaning liquid. Subsequently, a developer is applied thereon. Due to the remaining stain penetrated in the surface defects, the developer thereon is discolored to identify the defects that are hardly identified on the surface and specify the portion. Then, the developer on the defects in the specified portion is removed, and the defects are observed using a microscope of 500 times power. The maximum distance between two points selected from a rim of one defect when the base material is planarly viewed is employed as the length of the defect. In addition, the longest one of lengths of the observed ten defects is also employed as the length of the defect.

To control the lengths of the surface defects of the base material to 20 μm or less, there are provided a method of not polishing the material member and a method of polishing the material member. In the method of not polishing the material member, it is effective to lower a casting temperature within a scope which does not damage flowability of the molten material. For example, AZ61 is preferably cast at a temperature of 700° C. or less, and AZ91 is preferably cast at a temperature of 680° C. or less. In the method of polishing the material member, the surface of the material member is polished using an abrasive of #120 or more. At this time, it is preferable that the surface of the material member is polished within a range in which internal defects of the cast material, for example, intermetallic compounds of 20 μm or more are not exposed.

According to the magnesium alloy of the invention, it is preferable that the anticorrosive film of the magnesium alloy member is a chemical conversion treatment film or an anodic oxidation film.

Since a chemical conversion treatment film or an anodic oxidation film is used as an anticorrosive film, it is possible to effectively improve corrosion resistance of a magnesium alloy member.

Moreover, it is preferable that the content of Cr or Mn included in the anticorrosive film is 0.1% by mass or less. Cr is an element used for generating hexavalent chrome which is regulated in accordance with RoHS (Restriction of the use of certain Hazardous Substances in electrical and electronic equipment), and Mn is a substance registered in PRTR (Pollutant Release and Transfer Register: chemical material release and transfer notification system). Accordingly, Cr and Mn have a great effect on the environment. In RoHS, it is required to control the content of hexavalent chrome to 1000 ppm. Therefore, when the content of Cr included in the anticorrosive film is controlled to 0.1% by mass or less, it is possible to comply with RoHS, and when the content of Mn included in the anticorrosive film is controlled to 0.1% by mass or less, it is possible to lower the impact on the environment. Of cause, it is ideal that Cr or Mn is not included in the anticorrosive film. As the anticorrosive film in which Cr or Mn content is 0.1% by mass or less, a phosphate film can be used.

Further, it is preferable that a ratio of a corroded area to the entire area of the anticorrosive film after a 24-hour salt spray test (HS Z 2371) is 1% or less and electrical resistance of the anticorrosive film measured by a two-probe method is 0.2 Ω·cm or less.

By forming the anticorrosive film having characteristics that can pass the salt spray test, it is possible to produce a magnesium alloy member having high corrosion resistance. In the 24-hour salt spray test, saline water of 5% is sprayed to a test vessel set to a temperature of 35° C., and then corrosivity of a test piece in the test vessel is estimated. A corroded portion is blackened in comparison with a normal portion. Accordingly, it is possible to easily obtain the corroded portion by taking an image of a surface of the test piece subjected to the test and by processing the image. Then, a ratio of the corroded area to the entire area of the test piece is calculated.

Further, when the magnesium alloy member is used for housing for electronic equipments such as cellular phones, functions such as removing of high-frequency current or electromagnetic shielding can be provided to the housing by controlling the electrical resistance of the anticorrosive film measured by a two-probe method to 0.2 Ω·cm or less. Moreover, when a lead wire for grounding is connected to housing of electronic equipments, a contact resistance between the lead wire and the housing can be reduced. The electronic resistance can be controlled to 0.2 Ω·cm or less by, for example, reducing the thickness of the anticorrosive film. When the anticorrosive film is thin, corrosion resistance is lowered. However, by using a material member having a small number of surface defects, it is possible to realize satisfactory corrosion resistance even if the anticorrosive film is thin, and it is possible to reduce the resistance of the anticorrosive film as much as possible.

According to the aspect of the invention, it is preferable that a painting film is formed on the anticorrosive film.

Since the painting film is formed, it is possible to apply a color or a pattern to the surface of the magnesium alloy member, as well as to improve corrosion resistance. Accordingly, design options for the magnesium alloy member can be increased.

Particularly, it is preferable that the painting film includes an undercoat layer and an overcoat layer, and the painting film does not include a putty for compensating for surface defects of the undercoat layer.

When the paint application treatment is performed after performing the surface-preparation treatment on a material member having a large number of surface defects, existence of the defects is initially identified at the time of forming the undercoat layer in many cases. In such a case, it is necessary to fill the defects with a putty and perform a polishing treatment. Generally, known cast materials need to be repeatedly subjected to the undercoating treatment, overcoating treatment and polishing, and thus the paint application treatment becomes so complicated. However, when a material member having a small number of surface defects are used, puttying and polishing treatments can be avoided and a treatment efficiency of the paint application treatment can be substantially improved. In this case, since the painting film does not include the putty used in the putty treatment, the painting film can be uniformly formed.

According to the alloy of the invention, it is preferable that the magnesium alloy member includes an antibacterial film as an uppermost layer.

The magnesium alloy member has an antibacterial property since the antibacterial film is formed as the uppermost layer of the magnesium alloy member. Thus, it is possible to provide a more sanitary magnesium alloy member.

It is preferable that the antibacterial film includes antibacterial metal particulates. As the antibacterial fine metal particulates, particulates formed of nickel, copper, silver, gold, platinum, palladium, or an alloy containing two or more of these metals can be suitably used.

This antibacterial film and the above-mentioned painting film may be formed, independently. However, it is preferable that the painting film is the antibacterial film. As a result, it is possible to save the effort of separately forming the antibacterial film. For example, when the above-mentioned antibacterial fine metal particulates are included in a coating composition, the painting film includes an antibacterial property. If the painting film is not formed and the magnesium alloy member includes only the anticorrosive film, the antibacterial film may be formed on the anticorrosive film.

According to the magnesium alloy member of the invention, it is preferable that the magnesium alloy member has a tensile strength of 280 MPa or more, a 0.2% proof stress of 200 MPa or more, and an elongation rate of 10% or more. The magnesium alloy member satisfying the above mechanical properties can be suitably used as housing or structural materials of various equipments. The limits of such mechanical properties are particularly suitable for AZ61. In the case of AZ91, it is preferable that AZ91 has a tensile strength of 320 MPa or more, a 0.2% proof stress of 220 MPa or more, and an elongation rate of 10% or more. In addition, it is more preferable that AZ91 has a tensile strength of 340 MPa or more, a 0.2% proof stress of 240 MPa or more, and an elongation rate of 10% or more. A tensile strength is obtained by a tensile test according to JIS Z 2201. The 0.2% proof stress and the elongation rate are also obtained by results of the tensile test.

According to the aspect of the invention, it is preferable that the magnesium alloy member is suitably used for housing for electronic equipments. In greater detail, the magnesium alloy member according to the invention is suitable for housing for cellular phones, PDAs, notebook computers, or LCD or PDP televisions. In addition, the magnesium alloy member according to the invention can be used for body panels for transport machines such as automobiles or airplanes, sheet panels, engines, components around chassis, eyeglass frames, metal pipes of motorcycles such as mufflers and structural members such as pipes. When a material member used in the magnesium alloy member according to the invention is subjected to the shearing process or plasticity process after preparing the material member and eliminates the anticorrosion treatment or paint application treatment. Therefore, in a field which does not require surface treatment such as a field of components for an automobile, the material member is preferable used as a magnesium alloy member having small number of surface defect and excellent corrosion resistance. Specifically, Particularly, the magnesium alloy member corresponding to AZ61 or AZ91 is preferably used as a member not requiring surface treatments.

According to another aspect of the invention, a method of manufacturing a magnesium alloy member includes the steps of preparing a material member formed of a rolled magnesium alloy including 5 to 11% by mass of Al and performing an anticorrosion treatment to the material member.

According to this method, a magnesium alloy member having excellent mechanical properties and high corrosion resistance can be produced by using a material member including a large amount of Al. In addition, by using a rolled material as the material member, the number of surface defects at the time of casting is small and the frequency of compensation processes such as undercoating treatment and puttying can be reduced in the subsequent anticorrosion treatment.

That is, the method according to the invention basically includes the steps of "preparing a material member" and "performing an anticorrosion treatment". However, the following steps are additionally included in the method in accordance with a necessity for shearing process, a necessity for plasticity process, or a necessity for paint application treatment, as variations of a combination with other processes.

<First Group>

Preparing material member→Performing anticorrosion treatment; and

Preparing material member→Performing anticorrosion treatment→Paint application treatment.

<Second Group>

Preparing material member→Performing shearing process→Performing anticorrosion treatment;

Preparing material member→Performing shearing process→Performing anticorrosion treatment→Paint application treatment;

Preparing material member→Performing shearing process→Performing plasticity process→Performing anticorrosion treatment; and Preparing material member→Performing shearing process→Performing plasticity process→Performing anticorrosion treatment→Paint application treatment.

<Third Group>

Preparing material member→Performing anticorrosion treatment→Performing shearing process;

Preparing material member→Performing anticorrosion treatment→Performing shearing process→Performing plasticity process;

Preparing material member→Performing anticorrosion treatment→Performing shearing process→Performing plasticity process→Paint application treatment; and Preparing material member→Performing anticorrosion treatment→Performing shearing process→Paint application treatment.

Among these groups, the first group is a method of obtaining a magnesium alloy member having a rolled material which is subjected to the anticorrosion treatment but is not subjected to the shearing process and plasticity process. A typical example of products of the magnesium alloy member obtained in accordance with the method of the first group is a long-size plate wounded in a roll shape.

The second group is a method of performing the shearing process and subsequently performing the anticorrosion treatment to a material member. In this method, the anticorrosion treatment can be performed to the sheared material member which is segmented into small pieces having a predetermined geometry in advance. A typical example of the magnesium alloy member subjected to the shearing process but not subjected to the plasticity process is a plate piece. When performing the plasticity process as well as the shearing process, an anticorrosive film is not damaged at the time of plasticity process when the anticorrosion treatment is performed after the plasticity process. A typical example of products of the magnesium alloy member subjected to the shearing process and plasticity process is a chassis for various electric or electronic equipments.

The third group is a method of performing the anticorrosion treatment and subsequently performing the shearing process, plasticity process or the like to a material member. In this method, generally, the anticorrosion treatment can be performed to a long rolled material in a continuous manner. As a result, total productivity for producing an alloy member can be substantially improved in comparison with the case in which the sheared material member which is segmented into small pieces in advance is handled so as to perform the anticorrosion treatment to each piece.

In the method according to the invention, when the paint application treatment is performed, the paint application treatment generally includes an undercoating treatment and an overcoating treatment. It is preferable that the undercoating and overcoating treatments are each performed once.

As described above, the putty and polishing treatments can be avoided by using a material member having a small number of surface defects. Accordingly, the paint application treatment is completed by performing the undercoating treatment and the overcoating treatment once. As a result, it is possible to improve the efficiency of the paint application treatment.

In the producing method according to the invention, the step of preparing a material member preferably includes a step of obtaining a cast material including 5 to 11% by mass of Al and a step of warm-rolling the cast material.

It is possible to obtain a material member having a small number of surface defects and excellent mechanical properties by warm-rolling a cast material. Particularly, it is preferable to obtain a cast material by twin roll casting. The twin roll casting is one of casting methods using movable casting molds. By this twin roll casting, it is possible to obtain a cast material having a small number of surface defects.

It is preferable that the step of obtaining a cast material is performed by a rapid cooling solidification casting process at a cooling rate of 50 K/sec or more. The cast material obtained by the rapid cooling solidification casting process has a small number of internal defects, such as oxides or segregation. Thus, the rolled material obtained by rolling such rapidly cooled and solidified cast material has a smaller number of surface defects. The cooling rate is preferably 200 K/sec or more, more preferably 300 K/sec, and even more preferably 400 K/sec.

An example of the rapid cooling solidification casting process at a cooling rate of 50 K/sec or more is a twin roll casting process. Since rapid cooling solidification can be performed using twin rolls in the twin roll casting, the material member obtained by this method has a small number of internal defects such as oxides or segregation. A magnesium alloy including a large amount of Al has a problem in that intermetallic compounds or segregation is easily generated at the time of casting. Accordingly, even if the heat treatment or rolling process is performed after casting, crystallized or segregated products remains inside the finally obtained alloy plate, and thus the products may act as starting points of cracking at the time of plastic casting. However, it is possible to solve the problems by obtaining a material member with the twin roll casting.

Advantage of the Invention

A magnesium alloy member according to the invention can have high corrosion resistance and excellent mechanical properties. In addition, a surface treatment layer having high reliability can be formed on the magnesium alloy member according to the invention when a surface treatment including a anticorrosion treatment is performed.

BRIEF DESCRIPTION OF THE DRAWINGS

FIG. 1*a* shows an even portion, FIG. 1*a* shows an even portion.

BEST MODES FOR CARRYING OUT THE INVENTION

Figure 1A:
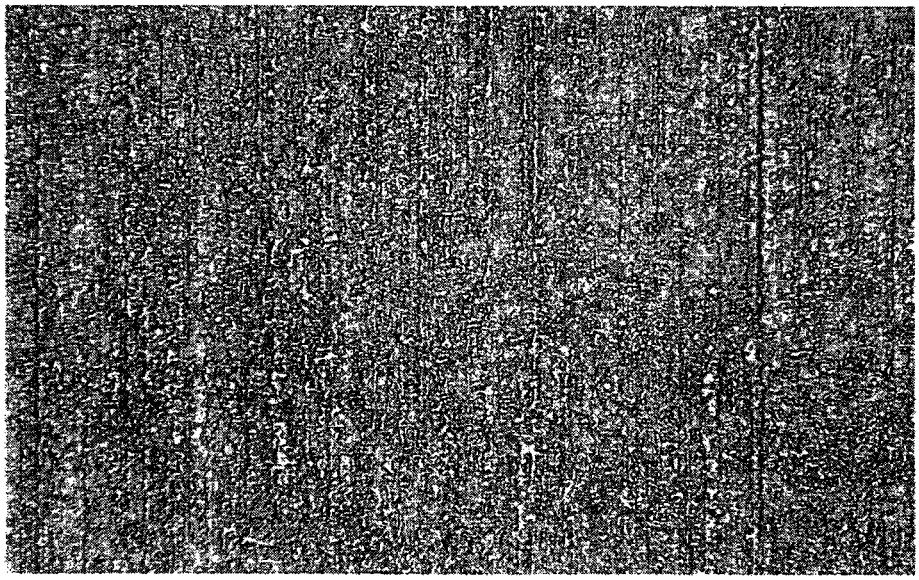
FIG. 1*a* shows an even portion of a microimage of an anticorrosive film on the magnesium alloy member related to Example 15.

Hereinafter, constitution requirements of the invention will be described in detail.

<Chemical Component of Magnesium Alloy>

A magnesium alloy used in the invention is an alloy including 5 to 11% by mass of Al. When the content of Al is below the lower limit, corrosion resistance of the material tends to be lowered, and when the content of Al exceeds the upper limit, moldability of the material tends to be lowered. The preferred content of Al is in the range of 6.0 to 10.0% by mass. The more preferred content of Al is in the range of 8.3 to 9.5% by mass in view of the corrosion resistance and mechanical properties. Moreover, an alloy including 0.2 to 1.5% by mass of Zn can be appropriately used as a material for the magnesium alloy member according to the invention. Additionally, a magnesium alloy may include Mn in the range of 0.15 to 0.5% by mass. In addition to these elements, impurities and Mg constitute a magnesium alloy. Specific examples of the alloy including 5 to 11% by mass of Al can include ASTM AZ61, AZ63, AZ80, AZ81, AZ91, AM60 and AM100.

<Method of Manufacturing Material Member>

A material member is a member to be subjected to an anticorrosion treatment. A rolled material in which a cast material is rolled can be typically used as the material member. In addition, a rolled material subjected to a heat treatment or a rolled material subjected to a leveler or polishing process to be described later may be used as the material member. Hereinafter, casting conditions and rolling conditions will be described in detail.

<Casting Conditions>

It is preferable to perform casting in accordance with a casting method described in WO/2006/003899. The casting method includes the steps of dissolving a magnesium alloy in a melting furnace to prepare a molten material, delivering the molten material from the melting furnace to a tundish, and performing casting by solidifying the molten material supplied to movable casting molds via a molten material injection port and by producing a cast material having a thickness in the range of 0.1 to 10.0 mm in a continuous manner. Over the processes from the dissolving step to the casting step, the portion which is in contact with the molten material is formed of a hypoxic material having an oxygen content of 20% by mass or less.

In a known continuous caster formed of aluminum, aluminum alloy, copper, copper alloy or the like, a crucible of a melting furnace, a tundish for storing a molten material supplied from the crucible, a molten material injection port for introducing the molten material to a movable casting mold, etc. are formed of ceramic such as silica (silicon oxide ($SiO_2$), oxygen content: 47% by mass), alumina (aluminum oxide ($Al_2O_3$), oxygen content: 53% by mass) or calcium oxide (CaO, oxygen content: 29% by mass). In continuous casting of a magnesium alloy, when a portion which is in contact with a magnesium alloy is formed by using a member including the above-mentioned oxides, magnesium oxides are formed, and thus a quality of surface is lowered. Moreover, the magnesium oxides act as a factor of cracking in the case in which the obtained cast material is subjected to a second process such as the rolling process. The magnesium oxides are not re-dissolved. Accordingly, when the magnesium oxides are mixed into the cast material along a flow of the molten material, it cause nonuniform solidification and deteriorates a quality of the surface of the cast material. In addition, when the cast material is subjected to the second process such as the rolling, the magnesium oxides in the cast material act as foreign particles and cracking is generated. Thus, quality deterioration occurs. The worst thing that can happen is that the second process can not be performed. Moreover, the deoxidized material may be missed and melted in a molten magnesium alloy, thereby partially lowering a temperature of the molten magnesium alloy and causing nonuniform solidification, and as a result, lowering the quality of the surface of the cast material. By using a material having a small oxygen content as a constituent material of the portion which is in contact with the molten material at the time of casting, the generation of magnesium oxides are suppressed and the formation of surface defects such as cracking at the time of second process is reduced. As a result, it is possible to obtain a cast material having a very small number of surface defects and a rolled material in which the cast material is rolled. In addition, it is possible to improve a yield in a surface treatment by performing the surface treatment including an anticorrosion treatment to the rolled material.

It is preferable to complete the solidification of molten material when the molten material is discharged from the movable casting molds (rolls). For example, the molten material is completely solidified when it passes through a minimum gap, which is the shortest distance between the rolls. That is, it is preferable to solidify the molten material such that a solidification completion point exists in a section between a flat surface including rotation axes of the rolls and a front end of the molten material injection port (offset section). In the case in which the solidification is completed in this section, the magnesium alloy introduced from the molten material injection port comes into contact with the casting molds until it is finally solidified, and is cooled from the casting mold side. Accordingly, it is possible to suppress generation of center line segregation.

A surface temperature of the magnesium alloy material (cast material) discharged from the movable casting molds is preferably 400° C. or less. When the cast material in an airtight section between the movable casting molds such as rolls is exposed to an atmosphere including oxygen (air or the like), the cast material is oxidized, thereby causing discoloration. It is possible to prevent the discoloration of the cast material from occurring by controlling the surface temperature of the cast material to 400° C. or less.

A heat treatment or ageing treatment for uniforming composition may be performed to the obtained cast material. As specific conditions thereof, a temperature is preferably in the range of 200 to 450° C. and a period of time is in the range of 1 to 40 hour(s). The temperature or period of time may be appropriately selected in accordance with a composition of the alloy.

A thickness of the cast material is preferably in the range of 0.1 to 10.0 mm. When the thickness is less than 0.1 mm, it is difficult to stably supply the molten material and obtain a long-size plate. On the other hand, when the thickness exceeds 10.0 mm, center line segregation is easily generated in the obtained cast material.

When the obtained cast material has a tensile strength of 150 MPa or more and a breaking elongation rate of 1% or more, reduction in plastic processability of the magnesium alloy material subjected to the second process can be lowered. For improving a strength and ductility, it is preferable that the structure of the casting material is refined to reduce the surface defects and the rolling process is performed to the cast material.

<Rolling Conditions>

It is preferable to use the following Rolling Condition 1 or 2.

(Rolling Condition 1)

Rolling conditions described in WO/2006/003899 can be used as Rolling Condition 1. In this rolling process, it is preferable to set a total rolling reduction to 20% or more. Columnar crystals, that are the structure of the cast material, remain when rolling is performed at a total rolling reduction of less than 20%. As a result, mechanical properties are easily uneven. Moreover, in order to substantially change a cast structure to a rolling structure (recrystallized structure), it is preferable to set a total rolling reduction to 30% or more. A total rolling reduction C(%) is obtained by the following expression, $(A-B)/A\times100$, where A (mm) is a thickness of a cast material and B (mm) is a thickness of a rolled material.

Rolling may be performed in a one pass manner or a multi-pass manner. When the rolling is performed in a multi-pass manner, the rolling reduction of each pass of rolling is preferably in the range of 1 to 50%. When the rolling reduction of each pass of rolling is less than 1%, the number of rolling increases to obtain a rolled material (rolled plate) having a desired thickness, thereby requiring much time and reducing productivity. In addition, when the rolling reduction of each pass of rolling is more than 50%, a processing degree is high. Accordingly, it is preferable to enhance plastic processability by appropriately heating a material prior to rolling. However, coarsening occurs in a crystal structure when heating is performed. Thus, there is a possibility that processability of the pressing process performed after the rolling is lowered. A rolling reduction C(%) of each pass of rolling is obtained by an expression of $(a-b)/a\times100$, where a (mm) is a thickness of a material before rolling and b (mm) is a thickness of the material after the rolling.

In the rolling process, the higher temperature T(° C.) may be selected from a temperature t1(° C.) of a material before rolling and a temperature t2(° C.) of the material at the time of rolling, and the temperature T(° C.) and the rolling reduction c(%) may satisfy the following expression, $100>(T/c)>5$. When (T/c) is 100 or more, rolling processability is high because of a temperature of a material is high, and a high processing degree can be employed. However, rolling is performed with a low processing degree, thereby increasing economic losses. On the other hand, when (T/c) is 5 or less, the rolling processability is low because of a temperature of a material is low. However, rolling is performed with a high processing degree, and thus cracking easily occurs on a surface of the material or inside the material at the time of rolling.

In addition, in the rolling process, it is preferable that a surface temperature of a material just before the material is inserted into mill rolls is controlled to 100° C. or less and a surface temperature of the mill rolls is set to 100 to 300° C. A material is indirectly heated since it comes into contact with the mill rolls heated as mentioned above. A rolling method in which a surface temperature of a material before rolling is controlled to 100° C. or less and surfaces of mill rolls at the time of substantial rolling is heated to 100 to 300° C. is referred to as "non-preheat rolling". Non-preheat rolling may be performed in a multi-pass manner, or may be performed only once in the last one pass of rolling after rolling that is not the non-preheat rolling is performed in a multi-pass manner. That is, the rolling that is not the non-preheat rolling may be performed as rough rolling and the non-preheat rolling may be performed as finish rolling. It is possible to obtain a rolled magnesium alloy material having a satisfactory strength and excellent plastic processability by performing the non-preheat rolling in the at least last one pass of rolling.

It is preferable that the rolling that is not the non-preheat rolling is warm-rolling in which a material is heated to 100 to 500° C. The material is preferably heated to 150 to 350° C. A rolling reduction of each pass of rolling is preferably in the range of 5 to 20%.

In the case in which casting is performed in a continuous manner and then rolling is performed in off-line, or in the case in which finish rolling is performed independently of rough rolling, it is preferable to perform a solution treatment to a material for 1 hour or more at a temperature in the range of 350 to 450° C. before the rolling is performed to the material. Thanks to the solution treatment, it is possible to eliminate remaining stress or strain occurring by a process, such as rough rolling prior to finish rolling, etc., and reduce a size of a texture formed during the process. In addition, it is possible to prevent unconsidered cracking, strain and deformation from occurring in the material in subsequent rolling. When the solution treatment is performed at a temperature of less than 350° C. for a period of less than 1 hour, the remaining stress-eliminating effect or texture-reducing effect becomes small. On the other hand, when the solution treatment is performed at a temperature of more than 450° C., energy for solution treatment wastes away. The upper limit of solution treatment time is about 5 hours.

It is preferable to perform a heat treatment to the rolled magnesium alloy material. When rolling is performed in a multi-pass manner, the heat treatment may be performed for each pass of rolling or several passes of rolling. As conditions for heat treatment, a temperature is in the range of 100 to 450° C. and a period of time is in the range of 5 minutes to 40 hours. By performing a heat treatment at a low temperature (for example, 100 to 350° C.) in the above temperature range for a short period of time (for example, about 5 minutes to 3 hours) in the above time period range, the remaining stress or strain occurring by rolling can be eliminated and mechanical properties can be improved. When the temperature for the heat treatment is too low or the period of time for the heat treatment is too short, recrystallization is not satisfactory and strain remains. On the other hand, when the temperature or period of time for the heat treatment is too high or too long, crystal particles becomes too coarse, and thus plastic processability of the pressing process, shearing process or the like becomes worse. When the solution treatment is performed, the heat treatment is performed at a high temperature (for example, 200 to 450° C.) in the above temperature range for a long period of time (for example, about 1 to 40 hour(s)) in the above time period range.

When a difference (absolute value) between an average crystal grain size of a surface portion of a rolled material and an average crystal grain size of a center portion of the rolled material is controlled to less than 20%, it is possible to more improve the processability of pressing process. When the difference is more than 20%, the structure becomes uneven and mechanical properties also becomes uneven. Thus, molding limit tends to be lowered. For controlling the above-mentioned average crystal grain size difference to less than 20%, for example, the non-preheat rolling may be performed in the at least last one pass of rolling. That is, it is preferable that strain uniformly occurs by performing rolling at a low temperature.

(Rolling Condition 2)

In addition, the rolling process preferably includes controlled rolling using the following requirements (1) and (2), where M (% by mass) is a content of Al included in a magnesium alloy constituting a rolled plate.

(1) a surface temperature of a magnesium alloy plate Tb(° C.) just before the magnesium alloy plate is inserted into mill rolls is controlled to a temperature satisfying the following expression.

$$8.33\times M+135 \leqq Tb \leqq 8.33\times M+165$$

here, $5.05 \leqq M \leqq 11.0$ (2) a surface temperature of mill rolls Tr is controlled to 150 to 180° C.

By setting the surface temperature of mill rolls Tr and the surface temperature of a magnesium alloy plate Tb as mentioned above, it is possible to perform the rolling process of the extent that crystal particles of the magnesium alloy are not recrystallized. As a result, it is possible to perform rolling in which coarsening of the crystal particles of the magnesium alloy is suppressed and cracking rarely occurs on the surface of the rolled material.

The surface temperature of mill rolls Tr is controlled to 150 to 180° C. When Tr is less than 150° C. and (rolling reduction)/(pass of rolling) increases, small cracks having an alligator skin shape may be formed in a direction perpendicular to a moving direction of the magnesium alloy plate at the time that the magnesium alloy plate is rolled. Further, when Tr is more than 180° C., the strain of the magnesium alloy plate accumulated during the rolling is released because of the recrystallization of the crystal particles of alloy. Accordingly, the amount of processing strain becomes small and it is difficult to refine the crystal particles.

The surface temperature of the mill rolls are controlled by using a method of disposing a heating element such as a heater inside the mill rolls or a method of exposing the surfaces of the mill rolls to warm air.

The surface temperature of a magnesium alloy plate Tb(° C.) just before the magnesium alloy plate is inserted into the mill rolls satisfies the following expression.

$$8.33\times M+135 \leqq Tb \leqq 8.33\times M+165$$

here, $5.0 \leqq M \leqq 11.0$

That is, the lower limit of the surface temperature Tb is about 177° C., and the upper limit thereof is about 257° C. The temperature Tb varies in accordance with M (% by mass), wherein M is the content of Al included in the magnesium alloy. In greater detail, Tb is set in the range of 185 to 215° C. when the magnesium alloy is ASTM AZ61, and Tb is set in the range of 210 to 247° C. when the magnesium alloy is ASTM AZ91. When Tb is below the lower limit of each composition, as in the case in which the surface temperature of the mill rolls is below the lower limit, small cracks having an alligator skin shape may be formed in a direction perpendicular to a moving direction of the magnesium alloy plate. When Tb exceeds the upper limit of each composition, the strain of the magnesium alloy plate accumulated during the rolling is released because of the recrystallization of the crystal particles of alloy. Accordingly, the amount of processing strain becomes small and it is difficult to refine the crystal particles.

Even when the surface temperature of a magnesium alloy plate Tb is set in the above-mentioned range, but when the surface temperature of the mill rolls is room temperature, the temperature Tb is lowered when the magnesium alloy plate comes into contact with the mill rolls. Accordingly, cracks are formed on the surface of the magnesium alloy plate. It is possible to effectively suppress the cracking by controlling the surface temperature of the magnesium alloy plate, as well as the surface temperature of the mill rolls.

A total rolling reduction of the controlled rolling is preferably in the range of 10 to 75%. The total rolling reduction is obtained by an expression of (thickness of plate before controlled rolling−thickness of plate after controlled rolling)/(thickness of plate before controlled rolling×100). When the total rolling reduction is less than 10%, the processing strain in a processed object is small and crystal particle refining-effect is small. On the other hand, when the total rolling reduction exceeds 75%, the processing strain in a processed object is large, and thus cracking may occur. For example, when a final thickness of plate is 0.5 mm, the controlled rolling is performed to a plate having a thickness in the range of 0.56 to 2.0 mm. More preferred total rolling reduction of the controlled rolling is in the range of 20 to 50%.

Further, (rolling reduction)/(pass of rolling (average rolling reduction of each pass of rolling)) of the controlled rolling is preferably in the range of 5 to 20%. When (rolling reduction)/(pass of rolling) is too low, it is difficult to efficiently perform the rolling. When (rolling reduction)/(pass of rolling) is too high, defects such as cracks are easily formed on a rolled object.

When the above-mentioned controlled rolling is performed in a multi-pass manner, it is preferable that at least one pass of rolling is performed in a reverse direction to the direction of other passes of rolling. Processing strain uniformly occurs in a rolled object by reversing a direction of rolling, in comparison with the case in which rolling is performed only in the same direction. Accordingly, it is possible to reduce a fluctuation in grain diameter after a final heat treatment generally performed after the controlled rolling.

As described above, rolling for a magnesium alloy plate includes the rough rolling and finish rolling. At least, the controlled rolling is preferably performed as the finish rolling. Considering additional improvement in the plastic processability, it is preferably to perform the controlled rolling over the entire rolling process. However, since the finish rolling has the greatest effect on suppression of the crystal particle coarsening in the finally-obtained magnesium alloy plate, it is preferable that the controlled rolling is performed as the finish rolling.

In other words, the rough rolling other than the finish rolling is not restricted to the rolling conditions of the controlled rolling. Particularly, the surface temperature of the magnesium alloy plate to be rolled has no special limitation. The surface temperature of the magnesium alloy plate to be rolled and the rolling reduction are adjusted in a manner such that the diameters of the crystals of the magnesium alloy plate decreases as much as possible. For example, in the case in which the initial thickness of a plate before rolling is 4.0 mm and the final thickness of the plate is 0.5 mm, the rough rolling is performed such that the thickness of the plate is reduced to 0.56 to 2.0 mm, and then the finish rolling is performed such that the thickness of the plate is reduced to 0.5 mm.

The improvement in a processing efficiency of the rough rolling can be expected by controlling the surface temperature of the mill rolls to 180° C. and increasing (rolling reduction)/(pass of rolling). In such a case, for example, (rolling reduction)/(pass of rolling) is preferably in the range of 20 to 40%. Even in this case where the surface temperature is 180° C. or more, the surface temperature of the mill rolls is preferably controlled to 250° C. or less in order to suppress the recrystallization of the crystal particles of the alloy.

Further, in the rough rolling process, when the surface temperature of a magnesium alloy plate Tb is controlled to 300° C. or more just before the magnesium alloy plate is inserted into the mill rolls and the surface temperature of mill rolls Tr is controlled to 180° C. or more, the surface state of the magnesium alloy plate after rough rolling becomes good, and thus edge cracking does not occur. When the surface temperature of a magnesium alloy plate is less than 300° C. and the surface temperature of mill rolls is less than 180° C., the rolling reduction can not be increased. Accordingly, the processing efficiency of the rough rolling process is reduced. The upper limit of the surface temperature of the magnesium alloy plate is not particularly limited. However, when the surface temperature of the magnesium alloy plate is high, the surface state of the magnesium alloy plate after the rough rolling may become bad. Therefore, the surface temperature of the magnesium alloy plate is preferably 400° C. or less. Also, the upper limit of the surface temperature of the mill rolls is not particularly limited. However, when the temperature of the mill rolls is high, the mill rolls may be damaged due to thermal fatigue. Therefore, the surface temperature of the mill rolls is preferably 300° C. or less.

When the rolling reduction of each pass of rolling is in the range of 20 to 40% in the rough rolling performed with the above-described temperature ranges, a fluctuation in grain diameter in the magnesium alloy plate can be reduced. When the rolling reduction of each pass of rolling at the time of rough rolling is less than 20%, an effect that the fluctuation in grain diameter after rolling is reduced is small, and when the rolling reduction of each pass of rolling at the time of rough rolling exceeds 40%, edge cracking occur in an end portion of the magnesium apply plate. In addition, in the rolling process performed at the rolling reduction in this range, since one pass of rolling has a small effect, it is preferable to perform at least two passes of rolling.

In the rolling (initial rough rolling) of a cast alloy plate, it is preferable to increase the temperature of the alloy plate and increase the rolling reduction within the above-mentioned rolling reduction range. In the rough rolling just before the finish rolling, it is preferable that the temperature of the alloy plate is about 300° C. and the rolling reduction is about 20%.

By performing the rough rolling under the above-described conditions and subsequently performing the finish rolling, it is possible to produce a magnesium alloy plate having more improved plastic processability. Specifically, the surface state of the magnesium alloy plate becomes good, the occurrence of edge cracking is suppressed, or a fluctuation in grain diameter in the magnesium alloy plate is reduced. In addition, the amount of segregation in the magnesium alloy plate may be reduced.

As the process conditions related to Rolling Condition 2, the solution treatment may be additionally performed to the cast material before rolling, if necessary. As conditions for the solution treatment, for example, a temperature is in the range of 380 to 420° C. and a period of time is in the range of 60 to 600 minutes, and a preferred temperature is in the range of 390 to 410° C. and a preferred period of time is in the range of 360 to 600 minutes. The amount of segregation can be reduced by performing the solution treatment in this manner. In the case of a magnesium alloy corresponding to AZ91 having a large amount of Al, it is preferable to perform the solution treatment for a long period of time.

Additionally, as necessary, strain-relief annealing may be performed during the rolling process (the rolling process may be the controlled rolling or not). It is preferable that the strain-relief annealing is performed between parts of passes of rolling in the rolling process. The starting point of the strain-relief annealing in the rolling process and the number of the strain-relief annealing are appropriately selected in accordance with the amount of strain accumulated in the magnesium alloy plate. By performing the strain-relief annealing, the subsequent rolling is performed more smoothly. As conditions for the strain-relief annealing, for example, a temperature is in the range of 250 to 350° C. and a period of time is in the range of 20 to 60 minutes.

It is also preferable to perform final annealing to the rolled material in which rolling is completely finished. The crystal structure of the magnesium alloy plate after the finish rolling has a large amount of processing strain. Accordingly, when the final annealing is performed, recrystallization is achieved in a manner such that the crystal structure is refined. That is, even in the case of the magnesium alloy plate in which the strain is released by performing the final annealing, the strength of the magnesium alloy plate is maintained high in order to have a refined, recrystallized structure. When the rolled material in which the structure of the alloy plate is recrystallized in advance is subjected to the plasticity process including the pressing process at a temperature of about 250° C., there is no great variation in the crystal structure before and after the plasticity process, such as coarsening of the crystal particles of the crystal structure in the magnesium alloy plate. Accordingly, in the magnesium alloy plate subjected to the final annealing, the strength of a portion in which plastic deformation occurs at the time of plasticity process is improved due to process-hardening, and the strength of a portion in which plastic deformation does not occur is maintained. As conditions for the final annealing, a temperature is in the range of 200 to 350° C. and a period of time is in the range of 10 to 60 minutes. In greater detail, the final annealing may be performed at a temperature in the range of 300 to 340° C. for 10 to 30 minutes when the content of Al is in the range of 8.5 to 10.0% and the content of Zn is in the range of 0.5 to 1.5% in the magnesium alloy.

In the plate produced by using a twin roll cast material, segregation occurs in the center portion of thickness of the plate at the time of casting. when a magnesium alloy includes Al, segregated products are mainly an intermetallic compound having a composition of $Mg_{17}Al_{12}$. The larger the content of impurities in the magnesium alloy, the easier the occurrence of the segregation. For example, when ASTM AZ type alloys are taken as an example, AZ91 in which a content of Al is about 9% by mass has a larger amount of segregation than AZ31 in which a content of Al is about 3% by mass after casting. Even though the case of AZ91 having a large amount of segregation, by performing the solution treatment before the rough rolling or finish rolling process under the appropriate conditions, as described in "Rolling Condition 2", segregation in a thickness direction of the magnesium alloy plate can be divided in a length of 20 μm or less. Here, "segregation part is divided" means that linear segregation is divided in a thickness direction or in a length direction. A criterion for the length of segregation in a thickness direction, which does not affect the plasticity process including the pressing process, is 20 μm or less. The length of segregation in a thickness direction is preferably less than 20 μm. When the longest length of segregation is divided in a length smaller than a grain diameter of a base material, strength characteristics may be more improved.

<Preliminary Process after Rolling and Before Process>

It is preferable to perform at least one of leveler and polishing processes to a rolled magnesium alloy material as a preliminary process before the shearing process. In the leveling process, for example, a rolled material is allowed to pass through a roller leveler in a manner such that nonuniformity of the rolled material and alignment of crystal particles, etc. are corrected. In the polishing process, a surface of a rolled material or a surface of a rolled material after the leveling process is polished to smooth the surface of the polished object. A typical example of the polishing is wet type belt polishing. At this time, #240 polishing belt can be used as a polishing condition. More preferred is a #320 polishing belt, and even more preferred is #600 polishing belt.

<Plasticity Process>

It is preferable to perform the plasticity process in a warm process. When the plasticity process includes the pressing process, deep-drawing process, forging process, blowing process, and bending process, it is preferable that a temperature of a material member (material member having an anticorrosive film, if it is subjected to the anticorrosion treatment) is in the range of 200 to 250° C. When the temperature at the time of plasticity process is about 250° C., an average crystal grain size of a non-processed portion (portion in which plastic deformation resulting from the plasticity process does not occur) of the material member rarely varies. Accordingly, the tensile strength of the non-processed portion before and after the plasticity process rarely varies.

The plasticity-processed portion may be subjected to the heat treatment. As conditions for the heat treatment, a temperature is in the range of 100 to 450° C. and a period of time is in the range of 5 minutes to 40 hours. For example, in order to eliminate strain occurring by a process, eliminate remaining stress occurring at the time of a process, and improve mechanical properties, the heat treatment may be performed at a low temperature (for example, 100 to 350° C.) in the above temperature range for a short period of time (for example, 5 minutes to 24 hours) in the above time period range. In addition, for the solution treatment, the heat treatment may be performed at a high temperature (for example, 200 to 450° C.) in the above temperature range for a long period of time (for example, 1 to 40 hours) in the above time period range.

<Surface Treatment Layer and Method of Forming the Same>

Typical examples of a surface treatment layer include a surface-preparation layer obtained by the surface-preparation treatment and a painting film obtained by the paint application treatment.

In the surface-preparation treatment, typically, degreasing, acid etching, desmutting, surface adjustment, anticorrosion treatment and drying are sequentially performed.

In the degreasing treatment, a cutting oil is removed by alkaline degreasing, and a parting agent used in rolling or pressing process is softened to be easily removed. For the degreasing treatment, a temperature is preferably in the range of 20 to 70° C. and a period of time is preferably in the range of 1 to 20 minutes.

In the acid etching treatment, a parting agent and metal impurities (Fe, Ni, Co, and Si) of an alloy, which are deposited on a surface of a material member, are dissolved and removed for each surface layer. At this time, metallic salts are deposited. For the acid etching treatment, a temperature is preferably in the range of 20 to 70° C. and a period of time is preferably in the range of 0.5 to 10 minutes.

In the desmutting treatment, smuts (surface oxides) deposited at the time of acid etching treatment are dissolved in an alkaline solution and removed. Simultaneously, a passivation film is formed by a reaction with magnesium. For the desmutting treatment, a temperature is preferably in the range of 20 to 70° C. and a period of time is preferably in the range of 2 to 20 minutes.

In the surface adjustment, the alkaline solution used in the desmutting treatment is cleaned and removed. For the surface adjustment, a temperature is preferably in the range of 20 to 70° C. and a period of time is preferably in the range of 1 to 10 minute(s).

The anticorrosion treatment is a treatment for forming a film for improving corrosion resistance of a surface of a magnesium alloy. In greater detail, a chemical treatment or anodizing treatment can be performed as the anticorrosion treatment. The chemical treatment is a treatment for forming an oxide film (chemical conversion treatment film) by a reaction with a magnesium alloy. Thanks to this treatment, it is possible to improve corrosion resistance of a magnesium alloy member and adhesion of a painting film formed on a chemical conversion treatment film. A treatment liquid for the chemical treatment can be broadly classified into a P-based liquid, a P—Mn-based liquid and a Cr-based liquid. Considering an effect of wastewater resulting from the treatment liquids on the environment, it is preferable to use a P-based treatment liquid not including Cr and Mn. When using a P-based treatment liquid for the chemical treatment, a temperature is preferably in the range of 20 to 70° C. and a period of time is preferably in the range of 0.5 to 4 minutes. On the other hand, the anodizing treatment is a treatment in which a direct current is applied to an anelectrode with the use of a magnesium alloy to form metal oxides of magnesium on a surface of the electrode. In greater detail, it is preferable to perform an anodizing treatment based on JIS H8651 (1995). It is preferable that a treatment liquid for an anticorrosive film obtained by the anodizing treatment does not include Cr and Mn and the anticorrosive film has small surface resistance.

From the above-mentioned degreasing to drying, water cleaning is performed between the processes. It is preferable the water cleaning is performed using deionized water.

In the paint application treatment, generally, the undercoating treatment, drying, overcoating treatment, and drying are sequentially performed. The undercoating treatment is performed by applying an epoxy resin coating composition or the like to a molded plate subjected to the surface preparation treatment. When surface defects are identified at the time of undercoating treatment, the surface defects are filled with a putty and then polishing is performed thereon. Then, the undercoating treatment is performed once again. As necessary, these processes, the undercoating treatment, puttying, and then undercoating treatment, are repeated more than once in this order. The overcoating treatment is performed by using an acrylic resin coating composition after the undercoating treatment. The drying treatment in the paint application treatment may be a baking and drying treatment at a temperature in the range of 100 to 200° C. in accordance with types or performances of a coating composition. Even when a temperature of a material member is about 160° C. in the paint application treatment, an average crystal grain size of the material member rarely varies. In addition, a tensile strength before and after the paint application treatment rarely varies.

On the other hand, to form an antibacterial film, it is preferable to use a metallic colloid solution described in JP-A-2005-248204. The metallic colloid solution includes metal particulates having an initial diameter of 200 nm or less, deposited by reducing metal ions in water, a dispersant having a molecular weight in the range of 200 to 30,000, and a mixed solvent of water as a disperse medium and an aqueous-organic solvent. An antibacterial film can be formed by mixing the metallic colloid solution into a coating composition. In addition, an antibacterial film can be formed independently of a painting film. In the metallic colloid solution, the metal particulates are preferably included by a ratio of 0.1 to 90% by weight. In addition, the dispersant is preferably an organic compound not including S, P, B and halogen atoms. Moreover, the dispersant is preferably included by a ratio of 2 to 30 parts by weight, based on 100 parts by weight of the metal particulates. At least one of a group including alcohols, ketones, glycol ethers and aqueous nitrogen-containing organic compounds can be selected to be used as the aqueous-organic solvent.

Test Example 1

Hereinafter, Examples and Comparative Examples of the invention will be described.

(1) A magnesium alloy member was produced in accordance with following Process 1 by using a twin roll-continuous cast and rolled material of AZ91 as a material member A.

Process 1: Casting→Warm Rolling→Leveling process→Polishing→Cutting→Warm Pressing Process→Surface-preparation Treatment→Paint application treatment→Drying Casting conditions of the twin roll-continuous casting for AZ91 and characteristics of the cast material are described in Table 1, and rolling conditions for the twin roll cast material of AZ91 and characteristics of the rolled material are described in Table 2. The casting conditions are conditions described in WO/2006/003899 and the rolling conditions are conditions based on "Rolling Condition 2" described above. Greater detail of the rolling conditions will be described below. A magnesium alloy plate having a thickness of 4.2 mm which had been obtained by the twin roll-continuous casting was subjected to rough rolling such that the thickness of the magnesium alloy plate was 1 mm, and a rough-rolled plate having an average crystal grain size of 6.8 μm was obtained. In the rough rolling, the object to be rolled was preheated to 300 to 380° C. and then the object was rolled by mill rolls having a surface temperature of 180° C. The average crystal grain size was obtained using an expression described in the cutting method of JIS G 0551 (2005). Next, the rough-rolled plate was subjected to finish rolling under the controlled rolling conditions described in Table 2, such that the thickness of the rough-rolled plate was 0.6 mm. The finish rolling was performed in a multi-pass manner, and at least one pass of rolling was performed in a reverse direction to the direction of other passes of rolling. Then, a heat treatment was performed to the finish-rolled plate at 320° C. for 30 minutes. In the leveling process, the rolled material was allowed to pass through a roller leveler to correct nonuniformity of the rolled material and alignment of the crystal particles, etc. In polishing, wet type belt polishing is performed using a #240 polishing belt to smooth the surface of the rolled material. In pressing, a temperature of a die were adjusted to 250° C., the object to be processed is held in the die for 12 seconds to be heated, and then pressing was performed at 2.5 min/sec. Thanks to this pressing, a case for a PDA for demonstration was obtained.

TABLE 1

| AZ91 twin roll casting | | |
|---|---|---|
| Casting Conditions | Casting Temperature (° C.) | 675° C. |
| | Cooling Rate (° C./sec) | 420° C./sec |
| | Thickness of cast material (mm) | 4.2 mm |
| | Casting Mold | Rotation Roll |
| | Temperature of Casting Mold (° C.) | 140° C. |
| Characteristics of Cast Material | Thickness of Material(mm) | 4.2 mm |
| | Size of Intermetallic Compound (μm) | 5.0 μm |
| | Fluctuation in Al Concentration max-min (%) | 8.8~9.2% |
| | Depth of Surface Defect depth/thickness | 3% |
| | Tensile Strength (MPa) | 241 MPa |
| | Breaking Elongation (%) | 1.4% |

TABLE 2

| AZ91 Rolling | | | |
|---|---|---|---|
| Rolling Conditions | Thickness before Rolling (mm) | | 4.2 mm |
| | Thickness after Rolling (mm) | | 0.6 mm |
| | Rolling Reduction of Each Pass of Rolling in Rough Rolling (%) | max | 35% |
| | | min | 20% |
| | Average Rolling Reduction of Each Pass of Rolling in Finish Rolling (%) | | 7% |
| | Rolling Reduction of Final Pass of Rolling (%) | | 7% |
| | Surface Temperature of Plate just before Finish Rolling (° C.) | | 220° C. |
| | Surface Temperature of Rolls in Finish Rolling (° C.) | | 170° C. |
| Characteristics of Rolled Material | Thickness of Material (mm) | | 0.6 mm |
| | Size of Intermetallic Compound (μm) | | 4.2 μm |
| | Size of Intermetallic Compound of Surface | | 5.0 μm or less |
| | Fluctuation in Al Concentration (%) | | 8.8~9.1% |
| | Average crystal grain size (μm) | | 5.6 μm |
| | Depth of Surface Defect depth/thickness | | 2% |
| | Length of Surface Defect | | 20 μm or less |
| | Tensile Strength (MPa) | | 342 MPa |
| | Breaking Elongation (%) | | 10.8% |

(2) A magnesium alloy member was produced in accordance with Process 2 by using a thixo-molded cast material of AZ91 as a material member B.

Process 2: Casting→Polishing→Surface-preparation treatment→Paint application treatment→Drying (3) A magnesium alloy member was produced in accordance with Process 1 by using an ingot-cast and rolled material of AZ31 as a material member C.

Ingot casting conditions for AZ31 are known conditions. Characteristics of the cast material obtained under the known conditions are described in Table 3, and rolling conditions for the cast material and characteristics of the rolled material are described in Table 4.

TABLE 3

| AZ31 Ingot Casting | | |
|---|---|---|
| Casting Conditions | Casting Temperature (° C.) | 695° C. |
| | Cooling Rate (° C./sec) | 12° C./ |
| | Thickness of cast material (mm) | 150 mm |

TABLE 3-continued

| AZ31 Ingot Casting | | |
|---|---|---|
| | Casting Mold | Rectangular Body |
| | Temperature of Casting Mold (° C.) | Room Temperature |
| Characteristics of Cast Material | Thickness of Material(mm) | 150 mm |
| | Size of Intermetallic Compound (μm) | 20 μm |
| | Fluctuation in Al Concentration max-min (%) | 2.8~3.5% |
| | Depth of Surface Defect depth/thickness | 12% |
| | Tensile Strength (MPa) | 212 MPa |
| | Breaking Elongation (%) | 2.4% |

TABLE 4

| AZ31 Rolling | | | |
|---|---|---|---|
| Rolling Conditions | Thickness before Rolling (mm) | | 150 mm |
| | Thickness after Rolling (mm) | | 0.6 mm |
| | Rolling Reduction of Each Pass of Rolling (%) | max | 25% |
| | | min | 9% |
| | Rolling Reduction of Final Pass of Rolling (%) | | 9% |
| Characteristics of Rolled Material | Thickness of Material (mm) | | 0.6 mm |
| | Size of Intermetallic Compound (μm) | | 17 μm |
| | Fluctuation in Al Concentration max-min (%) | | 2.8~3.3% |
| | Depth of Surface Defect depth/thickness | | 6% |
| | Tensile Strength (MPa) | | 263 MPa |
| | Breaking Elongation (%) | | 18.2% |

In the surface-preparation treatment of the above producing processes, degreasing, acid etching, desmutting, surface adjustment, chemical treatment and drying 1 were sequentially performed. Water cleaning was performed between the processes constituting the surface-preparation treatment. In the paint application treatment, the undercoating treatment, puttying, polishing, overcoating treatment and drying 2 were sequentially performed. The puttying and the polishing were performed in the case in which surface defects had been identified at the time of undercoating treatment. As necessary, these processes, the puttying, polishing, and then undercoating treatment, were repeated in this order.

The degreasing, acid etching, desmutting, surface adjustment and drying 1 were performed as follows unless the following were declined. Concentrations of solutions are expressed by mass %.

Degreasing: Under stirring of a 10% solution of KOH and a 0.2% nonionic surfactant solution, 60° C., 10 minutes Acid Etching: Under stirring of a 5% solution of phosphoric acid, 40° C., 1 minute Desmutting: Under stirring of a 10% solution of KOH, 60° C., 10 minutes Surface Adjustment Under stirring of a solution of carbonated water in which pH is adjusted to 8, 60° C., 5 minutes Drying 1: 120° C., 20 minutes The paint application treatment was performed under the following conditions:

Paint application treatment: Undercoating treatment (primer treatment) is performed by using an adhesion spray for a nonferrous metal, manufactured by Kanpe Hapio Co., Ltd., and then overcoating treatment is performed by using a black acrylic lacquer spray A, manufactured by Kanpe Hapio Co., Ltd.;

Puttying: Polyester putty; and

Drying 2: Drying at room temperature for 24 hours.

Producing conditions for examples and comparative examples are as follows.

Example 1

A pressed material of AZ91, subjected to the above processes from the twin roll-continuous casting to the warm pressing, was used as a treating base material. To this treating base material, the surface-preparation treatment and the paint application treatment were performed. In the surface-preparation treatment, a P-based treatment liquid including 10% phosphate as a main component and manufactured by A company, and a 10% solution of KOH were used as treatment liquids for the surface-preparation treatment. Under ultrasonic stirring of them, the chemical treatment was performed at 40° C. for 2 minutes. In Example 1 and Examples 2 to 7 to be described later, the undercoating treatment and the overcoating treatment were each performed once but the puttying and the polishing were not performed.

Example 2

A pressed material which was the same as that of Example 1 was used as a treating base material. To this treating base material, the surface-preparation treatment and the paint application treatment were performed. In the surface-preparation treatment, a P-based treatment liquid including 10% phosphate as a main component and manufactured by B company, and a 1% solution of KOH were used as treatment liquids for the surface-preparation treatment. Under ultrasonic stirring of them, the chemical treatment was performed at 90° C. for 1 minute.

Example 3

A pressed material which was the same as that of Example 1 was used as a treating base material. To this treating base material, the surface-preparation treatment and the paint application treatment were performed. In the surface-preparation treatment, a P—Mn-based treatment liquid including 10% manganese phosphate as a main component and manufactured by C company was used as a treatment liquid for the surface-preparation treatment. Under ultrasonic stirring of it, the chemical treatment was performed at 40° C. for 2 minutes.

Example 4

A pressed material which was the same as that of Example 1 was used as a treating base material. The surface-preparation treatment and the paint application treatment were performed in the same manner as in those of Example 1, except that the treating base material was subjected to a phosphate treatment in the etching process and then processed in a 3% solution of HF at 30° C. for 1 minute. The chemical treatment was performed in the same manner as in that of Example 1, except that a P—Mn-based treatment liquid including 10% manganese phosphate as a main component and manufactured by D company was used as a treatment liquid.

Example 5

A pressed material which was the same as that of Example 1 was used as a treating base material. A magnesium alloy was processed with reference to a preliminary corrosion proofing method for an unfinished part, which is a magnesium alloy corrosion proofing method (JIS H 8651 (1995)) of the first kind. That is, the treating base material was dipped into a solution of sodium bichromate of 180 g/L and nitric acid (60%) of 260 ml/L at a solution temperature of 25° C. for 1 minute and then droplets were removed for 5 seconds. Subsequently, the treating base material was cleaned with water, and then dried, thereby obtaining a Cr-based chemical conversion treatment film. All of the treatments were performed in the same manner as in Example 1, except for the chemical treatment.

Example 6

A pressed material which was the same as that of Example 1 was used as a treating base material. The treating base material was processed with reference to a preliminary corrosion proofing method for an unfinished part, which is a magnesium alloy corrosion proofing method (JIS H 8651 (1995)) of the eighth kind. That is, the treating base material was dipped into a solution of acidic sodium fluoride of 15 g/L, sodium bichromate of 180 g/L, aluminum sulfate of 10 g/L and nitric acid (60%) of 84 ml/L at a solution temperature of 20° C. for 2 minutes, cleaned with water, and then dried, thereby obtaining a Cr-based chemical conversion treatment film. All of the treatments were performed in the same manner as in Example 1, except for the chemical treatment.

Example 7

A pressed material which was the same as that of Example 1 was used as a treating base material. A magnesium alloy was processed with reference to a good corrosion proofing method for a finished part, which is a magnesium alloy corrosion proofing method (JIS H 8651 (1995)) of the third kind. That is, as a first process, the treating base material was dipped into a solution of hydrofluoric acid (46%) of 250 ml/L at a solution temperature of 20° C. for 5 minutes and then cleaned with water. Next, as a second process, the treating base material was dipped into a solution of sodium bichromate of 120 to 130 g/L and calcium fluoride of 2.5 g/L at a solution temperature of 90° C. for 60 minutes, cleaned with water, dipped into warm water, and then dried, thereby obtaining a Cr-based chemical conversion treatment film. All of the treatments were performed in the same manner as in Example 1, except for the chemical treatment.

Example 8

A pressed material which was the same as that of Example 1 was used as a treating base material. In the surface-preparation treatment, alkaline degreasing, acid cleaning, anodizing treatment, and drying were sequentially performed. For an alkaline degreasing solution and an acid cleaning solution, a degreasing solution for a chemical treatment and an acid etching solution were used, respectively. The anodizing treatment was performed with reference to A type of a good corrosion proofing method for a finished part, which is a magnesium alloy corrosion proofing method (JIS H 8651 (1995)) of the eleventh kind. In greater detail, a treatment liquid of potassium hydroxide of 165 g/L, potassium fluoride of 35 g/L, sodium phosphate of 35 g/L, aluminum hydroxide of 35 g/L and potassium permanganate of 20 g/L was used to dip the treating base material thereinto at a solution temperature of 20° C., a current density of 2.0 A/dm$^2$ and a voltage of 70 V for 20 minutes. Then, the treating base material was cleaned with water and dried, thereby obtaining a P—Mn-based anodic oxidation film. Subsequently, the paint application treatment was performed under the above-described conditions.

Example 9

A pressed material which was the same as that of Example 1 was used as a treating base material. All of the treatments were performed in the same manner as in Example 8, except that a P-based treatment liquid including phosphate and manufactured by E company was used as a treatment liquid for anodizing.

Comparative Examples 1 to 7

All of the treatments of Comparative Examples 1 to 7 were performed in the same manners as in Examples 1 to 7, respectively, except that a thixo-molded cast material of AZ91 was used as a treating base material. In Comparative Examples 1 to 7, the overcoating treatment was performed once but the undercoating treatment, puttying and polishing were performed more than once.

Comparative Examples 8 to 14

All of the treatments of Comparative Examples 8 to 14 were performed in the same manners as in Examples 1 to 7, respectively, except that an ingot-cast material of AZ31, rolled, polished and pressed material of AZ31 was used as a treating base material. In Comparative Examples 8 to 14, the undercoating treatment and the overcoating treatment were performed once but the puttying and the polishing were not performed.

Comparative Examples 15 and 16

All of the treatments of Comparative Examples 15 and 16 were performed in the same manners as in Examples 8 and 9, respectively, except that a thixo-molded cast material of AZ91 was used as a treating base material. In Comparative Examples 15 and 16, the overcoating treatment was performed once but the undercoating treatment, puttying and polishing were performed more than once.

Comparative Examples 17 and 18

All of the treatments of Comparative Examples 17 and 18 were performed in the same manners as in Examples 8 and 9, respectively, except that an ingot-cast material of AZ31, rolled, polished and pressed material of AZ31 was used as a treating base material. In Comparative Examples 17 and 18, the undercoating treatment and the overcoating treatment were performed once but the puttying and the polishing were not performed.

Evaluation for electrical resistance of a chemical conversion treatment film, evaluation for corrosion resistance, evaluation for adhesion of a chemical conversion treatment film, evaluation for adhesion of a painting film and evaluation for environmental burden were performed in Examples 1 to 9 and Comparative Examples 1 to 18. Each evaluation method is as follows.

<Electrical Resistance Evaluation>

Surface resistance of an obtained film was measured by a two-probe method using two-probe type MCP-TPAP with Rolester manufactured by Mitsubishi Chemical Corporation.

<Adhesion Evaluation>

Adhesion of an anticorrosive film and adhesion of a painting film were evaluated by JIS cross-cut peeling test (JIS K 5400 8.5.2 (1990)). A cutter knife is used to form 100 cross-cuts at intervals of 1 mm on an anticorrosive film or a painting film. A cellophane adhesion tape is strongly attached onto the cross-cuts and then is rapidly removed from one end thereof. The number of cross-cuts on the material member, which are not peeled off but remain, is observed.

<Corrosion Resistance Evaluation>

Corrosion resistance was evaluated by a salt spray test (SST, HS Z 2371 (2000)). In a 24-hour salt spray test, saline water of 5% is sprayed to a test vessel, the temperature of which is set to 35° C., and then a test piece is left in the test vessel for 24 hours. The corrosion resistance of the test piece is evaluated. Herein, a material plate on which an anticorrosive film is formed is used as the test piece. Corroded portions are blackened in comparison with normal portions. Accordingly, the corroded area can be easily obtained by taking an image of the surface of the test piece after the test and processing the image. A ratio of the corroded area to the entire area of the test piece is calculated. When the ratio is 1% or less, the test piece is determined as acceptable.

<Environmental Burden>

Non-acceptance (Δ or x) is decided when a substance registered in PRTR or a substance regulated in accordance with RoHS is included in a treatment liquid for a chemical treatment, and Acceptance (O) is decided when the substances are not included in the treatment liquid.

Each test result is described in Tables 5 to 7. In Tables 5 to 7, "material plate" means the above-mentioned material member.

TABLE 5

| Testing Material | Material | Anticorrosive Treatment Liquid | Surface Resistance (Ω · cm) | Corrosion Resistance (Ratio of Corroded Area) | Adhesion of Anticorrosive Film (X/100) | Adhesion of Coating (X/100) | Impact on Environment |
|---|---|---|---|---|---|---|---|
| Example 1 | Material Plate A | P-based | 0.1 | 1% or less | 100 | 100 | ○ |
| Example 2 | Material Plate A | P-based | 0.2 | 1% or less | 100 | 100 | ○ |
| Example 3 | Material Plate A | P—Mn-based | 0.2 | 1% or less | 100 | 100 | Δ Substance registered in PRTR (Mn) |
| Example 4 | Material Plate A | P—Mn-based | 0.3 | 1% or less | 100 | 100 | Δ~x Substance registered in PRTR (Mn) HF Poison |
| Example 5 | Material Plate A | Cr-based | 0.2 | 1% or less | 100 | 100 | x Substance regulated in |

TABLE 5-continued

| Testing Material | Material | Anticorrosive Treatment Liquid | Surface Resistance (Ω · cm) | Corrosion Resistance (Ratio of Corroded Area) | Adhesion of Anticorrosive Film (X/100) | Adhesion of Coating (X/100) | Impact on Environment |
|---|---|---|---|---|---|---|---|
| | | | | | | | accordance with RoHS ($Cr \rightarrow Cr^{6+}$) |
| Example 6 | Material Plate A | Cr-based | 0.2 | 1% or less | 100 | 100 | x Substance regulated in accordance with RoHS ($Cr \rightarrow Cr^{6+}$) |
| Example 7 | Material Plate A | Cr-based | 0.6 | 1% or less | 100 | 100 | x Substance regulated in accordance with RoHS ($Cr \rightarrow Cr^{6+}$) |
| Example 8 | Material Plate A | P—Mn-based | 10 | 1% or less | 100 | 100 | Δ Substance registered in PRTR (Mn) |
| Example 9 | Material Plate A | P-based | 0.2 | 1% or less | 100 | 100 | ○ |

TABLE 6

| Testing Material | Material | Anticorrosive Treatment Liquid | Surface Resistance (Ω · cm) | Corrosion Resistance (Ratio of Corroded Area) | Adhesion of Anticorrosive Film (X/100) | Adhesion of Coating (X/100) | Impact on Environment |
|---|---|---|---|---|---|---|---|
| Comparative Example 1 | Material Plate B | P-based | 0.1 | 10% | 100 | 100 | ○ |
| Comparative Example 2 | Material Plate B | P-based | 0.2 | 5% | 100 | 100 | ○ |
| Comparative Example 3 | Material Plate B | P—Mn-based | 0.2 | 1% or less | 100 | 100 | Δ Substance registered in PRTR (Mn) |
| Comparative Example 4 | Material Plate B | P—Mn-based | 0.3 | 1% or less | 100 | 100 | Δ~x Substance registered in PRTR (Mn) HF Poison |
| Comparative Example 5 | Material Plate B | Cr-based | 0.2 | 1% or less | 100 | 100 | x Substance regulated in accordance with RoHS ($Cr \rightarrow Cr^{6+}$) |
| Comparative Example 6 | Material Plate B | Cr-based | 0.2 | 1% or less | 100 | 100 | x Substance regulated in accordance with RoHS ($Cr \rightarrow Cr^{6+}$) |
| Comparative Example 7 | Material Plate B | Cr-based | 0.6 | 1% or less | 100 | 100 | x Substance regulated in accordance with RoHS ($Cr \rightarrow Cr^{6+}$) |

TABLE 7

| Testing Material | Material | Anticorrosive Treatment Liquid | Surface Resistance (Ω · cm) | Corrosion Resistance (Ratio of Corroded Area) | Adhesion of Anticorrosive Film (X/100) | Adhesion of Coating (X/100) | Impact on Environment |
|---|---|---|---|---|---|---|---|
| Comparative Example 8 | Material Plate C | P-based | 0.3 | 30% | 100 | 100 | ○ |
| Comparative Example 9 | Material Plate C | P-based | 4 | 20% | 100 | 100 | ○ |
| Comparative Example 10 | Material Plate C | P—Mn-based | 0.5 | 15% | 99 | 100 | Δ Substance registered in PRTR (Mn) |

TABLE 7-continued

| Testing Material | Material | Anticorrosive Treatment Liquid | Surface Resistance (Ω · cm) | Corrosion Resistance (Ratio of Corroded Area) | Adhesion of Anticorrosive Film (X/100) | Adhesion of Coating (X/100) | Impact on Environment |
|---|---|---|---|---|---|---|---|
| Comparative Example 11 | Material Plate C | P—Mn-based | 0.5 | 5% | 99 | 100 | Δ~x Substance registered In PRTR (Mn) HF Poison |
| Comparative Example 12 | Material Plate C | Cr-based | 0.5 | 1% or less | 96 | 97 | x Substance regulated in accordance with RoHS ($Cr \rightarrow Cr^{6+}$) |
| Comparative Example 13 | Material Plate C | Cr-based | 0.5 | 1% or less | 94 | 93 | x Substance Regulated in accordance with RoHS ($Cr \rightarrow Cr^{6+}$) |
| Comparative Example 14 | Material Plate C | Cr-based | 0.7 | 1% or less | 98 | 95 | x Substance regulated In accordance with RoHS ($Cr \rightarrow Cr^{6+}$) |
| Comparative Example 15 | Material Plate B | P—Mn-based | 10 | 1% or less | 100 | 100 | Δ Substance registered in PRTR (Mn) |
| Comparative Example 16 | Material Plate B | P-based | 0.2 | 1% or less | 100 | 100 | ○ |
| Comparative Example 17 | Material Plate C | P—Mn-based | 20 | 10% | 95 | 96 | Δ Substance registered in PRTR (Mn) |
| Comparative Example 18 | Material Plate C | P-based | 0.6 | 20% | 92 | 94 | ○ |

As described in Table 5, it can be seen that excellent corrosion resistances, adhesions of anticorrosive films and adhesions of coatings are obtained in Examples 1 to 9. In addition, each surface resistance of an anticorrosive film is 0.2 Ω·cm or less in Examples, except for Examples 4, 7 and 8. Moreover, impact on the environment is small in each Example in which a P-based treatment liquid is used as a treatment liquid for an anticorrosion treatment. In each Example, the puttying and the subsequent polishing are not required because the undercoating treatment and overcoating treatment of the paint application treatment are each performed once.

On the other hand, as shown in Table 6, excellent adhesions of chemical conversion treatment films and adhesions of painting films are obtained in Comparative Examples 1 to 7 because AZ91 is used. However, since it is a cast material, the strength of each Comparative Example is lower than those of Examples 1 to 9. In addition, Comparative Examples 1 and 2 are deteriorated in corrosion resistance in comparison with Examples 1 and 2. Since cast materials are used in Comparative Examples 1 to 7, a large number of surface defects are obtained in Comparative Examples. Therefore, the puttying and the subsequent polishing are required in the paint application treatment and the undercoating treatment is repeated more than once in Comparative Examples.

In addition, as shown in Table 7, since AZ31 is used in Comparative Example 8 to 14, 17 and 18, corrosion resistances or adhesions of chemical conversion treatment (anodic oxidation) films and painting films are lower than those of Examples. In addition, surface resistances of chemical conversion treatment films are substantially high. Since AZ91 is used in Comparative Example 15 and 16, adhesions of anodic oxidation films and adhesions of painting films are excellent. However, since AZ91 is a cast material, strengths are lower than those of Examples 1 to 9.

In the above Examples, material members subjected to press molding are exemplified and explained. However, even if the deep-drawing process, forging process, blowing process, and bending process are performed to the material member in addition to the press molding, surface treatment simplification can be expected as in the cases of the Examples.

Test Example 2

Next, material plates (material members) of AZ91, obtained under the finish rolling conditions different from those of Test Example 1, were used and the press molding and the surface treatment (surface-preparation treatment and paint application treatment) were performed to the material plates. Characteristics after rolling and film-forming properties of a surface treatment layer in each material plate were evaluated. Casting conditions, leveler, polishing and heat treatment conditions after the rolling, or pressing conditions are the same as those for the material member A of Test Example 1. Surface treatment conditions are the same as in Example 1 of Test Example 1. The rolling conditions and evaluation results are described in Table 8.

TABLE 8

| Sample No. | Temperature of Plate (° C.) | Temperature of Rolls (° C.) | Direction of Rolling | Average Rolling Reduction of Each Pass of Rolling (%) | Surface State | Edge Cracking | Average Grain diameter (μm) | Deep Drawability |
|---|---|---|---|---|---|---|---|---|
| 2-1 | 210 | 169 | R | 8 | ○ | ○ | 4.3 | ○ |
| 2-2 | 230 | 167 | R | 7 | ○ | ○ | 4.4 | ○ |
| 2-3 | 240 | 170 | R | 8 | ○ | ○ | 4.5 | ○ |
| 2-4 | 225 | 166 | R | 15 | ○ | Δ | 4.0 | ○ |
| 2-5 | 230 | 160 | R | 15 | ○ | Δ | 4.1 | ○ |

Direction of Rolling: "R" means that the direction of rolling is reversed.

In Table 8, "temperature of plate" means a surface temperature of a plate just before the finish rolling; "temperature of rolls" means a surface temperature of mill rolls for the finish rolling; directing of rolling "R" means that a directing of rolling is reversed every pass of rolling; and "average rolling reduction of each pass of rolling" means (total rolling reduction)/(number of pass of rolling) in finish rolling (here, the finish rolling is performed such that a thickness of a plate becomes from 1 mm to 0.6 mm). In addition, in "surface state", "O" means that there is no crack or wrinkle in the rolled material; in "edge cracking", "O" means that there is no crack in an edge of the rolled material and "Δ" means that there is a very small number of cracks in the edge of the rolled material; and in "deep drawability", "O" means that there is no crack in an angled portion of a processed product. These meanings and evaluation criteria of Table 8 are identical to those for other Test Examples to be described later.

As shown in Table 8, all of the samples have a small average crystal grain size and are excellent in processability. In addition, it was found that the undercoating treatment and the overcoating treatment are each performed once, but the puttying and the polishing are not required when the surface-preparation treatment and the paint application treatment are performed to a pressed and molded plate.

Test Example 3

Next, by using twin roll cast materials having a different content of Al from that of Test Example 1, evaluations about effects of a temperature of a plate, a temperature of rolls and the like at the time of finish rolling were performed as Test Example 2. Plates of Test Example 3 includes 9.8% by mass of Al, 1.0% by mass of Zn, and other additional elements except for Al and Zn, which are permissive in AZ91. The balance includes Mg and unavoidable impurities. Casting conditions and conditions for the leveler, polishing and heat treatment after the rolling are the same as those for the material member A of Test Example 1. The same press molding performed in Test Example 1 and the same surface treatment performed in Example 1 were performed to samples after the heat treatment and then an evaluation for the surface treatment states was performed. Rolling conditions and evaluation results are described in Table 9.

TABLE 9

| Sample No. | Temperature of Plate (° C.) | Temperature of Rolls (° C.) | Direction of Rolling | Average Rolling Reduction of Each Pass of Rolling (%) | Surface State | Edge Cracking | Average Grain Diameter (μm) | Deep Drawability |
|---|---|---|---|---|---|---|---|---|
| 3-1 | 230 | 170 | R | 7 | ○ | ○ | 4.4 | ○ |
| 3-2 | 230 | 175 | R | 15 | ○ | ○ | 4.2 | ○ |

Direction of Rolling: "R" means that the direction of rolling is reversed.

As shown in Table 9, even in the case of a material plate of a magnesium alloy including 9.8% by mass of Al, the material plate is excellent in processability as AZ91. In addition, as Test Example 2, when the surface-preparation treatment and the paint application treatment are performed to the material plate after the press molding, the undercoating treatment and the overcoating treatment are each performed once, but the puttying and the polishing are not required.

Test Example 4

Next, by providing twin roll cast materials having a thickness of 4.0 mm and performing the rough rolling to the cast materials so as to have a predetermined thickness, rough-rolled plates having a thickness different from the above thickness were obtained. In the rough rolling, cast materials were preheated in the range of 300 to 380° C. and rolled by mill rolls having room temperature. The finish rolling was performed to the rough-rolled plates with different total rolling reductions such that the thickness of each rough-rolled plate was 0.5 mm. Thus, finish-rolled materials were obtained. In the finish rolling, a surface temperature of each rough-rolled plate just before the finish rolling was controlled to 210 to 240° C., and at that time, a surface temperature of mill rolls for finishing was controlled to 150 to 180° C. Then, as Test Example 1, a heat treatment was performed to the finish-rolled materials at 320° C. for 30 minutes. As a result, samples were obtained. Casting conditions are the same as those for the material member A of Test Example 1, except for the thickness of the cast material, and conditions for leveler and polishing after the rolling are also the same as those for the material member A of Test Example 1. The same press molding performed in Test Example 1 and the same surface treatment performed in Example 1 were performed to the obtained samples and then an evaluation for the surface treatment states was performed.

In accordance with the same method used in Test Example 2, measurement of an average crystal grain size, evaluation of a state of a plate surface and evaluating of edge cracking were performed to each sample. Conditions for the finish rolling and evaluation results are described in Table 10. "total rolling reduction" means a total rolling reduction in finish rolling performed in a manner such that the thickness of the rough-rolled material is reduced up to the thickness of the finish-rolled material. That is, it means a total rolling reduction in rolling in which the surface temperature of the plate is controlled to 210 to 240° C.

TABLE 10

| Sample No. | Average Rolling Reduction of Each Pass of Rolling (%) | Total Rolling Reduction in Rolling in which Surface Temperature of Plate is in range of 210 to 240° C. (%) | Surface State | Edge Cracking | Average Grain diameter (μm) |
|---|---|---|---|---|---|
| 4-1 | 5 | 10 | ○ | ○ | 5.2 |
| 4-2 | 8 | 18 | ○ | ○ | 4.8 |
| 4-3 | 7 | 20 | ○ | ○ | 4.8 |
| 4-4 | 9 | 24 | ○ | ○ | 4.6 |
| 4-5 | 12 | 24 | ○ | ○ | 4.5 |
| 4-6 | 10 | 28 | ○ | ○ | 4.8 |
| 4-7 | 14 | 28 | ○ | Δ | 4.7 |
| 4-8 | 9 | 35 | ○ | ○ | 4.4 |
| 4-9 | 8 | 40 | ○ | ○ | 4.4 |
| 4-10 | 8 | 45 | ○ | ○ | 4.4 |
| 4-11 | 15 | 45 | ○ | ○ | 4.0 |
| 4-12 | 8 | 50 | ○ | ○ | 4.5 |

As shown in Table 10, excellent results can be obtained when an average rolling reduction of each pass of rolling is in the range of 5 to 15% and a total rolling reduction is in the range of 10 to 50% in the controlled rolling. In addition, in the case in which a material plate after the press molding is subjected to the surface-preparation treatment and the paint application treatment, the undercoating treatment and the overcoating treatment are each performed once, and the puttying and the polishing are not required.

Test Example 5

Next, by using twin roll cast materials of a magnesium alloy having a different content of Al from that of Test Example 4, effects of a total rolling reduction and an average rolling reduction of each pass of rolling in finish rolling were evaluated as Test Example 4. Plates of Test Example 5 includes 9.8% by mass of Al, 1.0% by mass of Zn, and other additional elements except for Al and Zn, which are permissive in AZ91. The balance includes Mg and unavoidable impurities. In the finish rolling, a surface temperature of each rough-rolled plate just before the finish rolling was controlled to 217 to 247° C., and at that time, a surface temperature of mill rolls for finishing was controlled to 150 to 180° C. Producing conditions and evaluation methods of the magnesium alloy plates are the same as in Test Example 4, except for the chemical components of the magnesium alloys and the rough rolling conditions. The same press molding performed in Test Example 1 and the same surface treatment performed in Example 1 were performed to obtained samples and then an evaluation for the surface treatment states was performed. The finish rolling conditions and results of the test are described in Table 11.

TABLE 11

| Sample No. | Average Rolling Reduction of Each Pass of Rolling (%) | Total Rolling Reduction in Rolling in which Surface Temperature of Plate is in the range of 217 to 247° C. (%) | Surface State | Edge Cracking | Average Grain diameter (μm) |
|---|---|---|---|---|---|
| 5-1 | 8 | 18 | ○ | ○ | 4.8 |
| 5-2 | 10 | 28 | ○ | ○ | 4.9 |
| 5-3 | 8 | 40 | ○ | ○ | 4.4 |
| 5-4 | 8 | 50 | ○ | ○ | 4.5 |

As shown in Table 11, excellent results can be obtained when an average rolling reduction of each pass of rolling is in the range of 8 to 10% and a total rolling reduction is in the range of 18 to 50% in the controlled rolling. In addition, in the case in which a material plate after the press molding is subjected to the surface-preparation treatment and the paint application treatment, the undercoating treatment and the overcoating treatment are each performed once, and the puttying and the polishing are not required.

Summary of Test Examples 1 to 5

From the results of Test Examples 1 to 5, a graph of the relation between Tb and M was made and summarized. Tb (° C.) is a surface temperature of a cast material just before the cast material is inserted into mill rolls, and M (mass %) is a content of Al included in a magnesium alloy constituting the cast material. As a result, when the controlled rolling in which the surface temperature of a material plate Tb satisfies the following expression and the surface temperature of mill rolls Tr is controlled to 150 to 180° C. is performed, a magnesium alloy plate having excellent plastic processability can be obtained because the grain diameter thereof is small.

$$8.33\times M+135\leqq Tb\leqq 8.33\times M+165$$

here, $8.3\leqq M\leqq 9.8$

In these Test Examples, evaluations are not performed to a magnesium alloy having a content of Al smaller than that of AZ91 and a magnesium alloy having a content of Al larger than 9.8% by mass. However, considering that one having a large content of Al is small in processability and one having a small content of Al is small in corrosion resistance, the above expression is satisfied when the content of Al is in the range of 5.0 to 11.0% by mass.

Test Example 6

Next, by the twin roll-continuous casting with a composition including 9.0% by mass of Mg, 1.0% by mass of Al and Zn and corresponding to AZ91, a magnesium alloy material plate having a thickness of 4 mm was prepared. The rough rolling was performed to the material plates under different conditions such that a thickness of each material plate was reduced up to 1 mm. Thus, a plurality of rough-rolled plates were obtained. Then, the plurality of rough-rolled plates were subjected to the finish rolling under the same conditions such that a thickness of each finally obtained plate was reduced up to 0.5 mm. As a result, magnesium alloy plates were obtained. In the finish rolling, a surface temperature of each rough-rolled plate just before the finish rolling was controlled to 210 to 240° C. and a surface temperature of mill rolls for finishing was controlled to 150 to 180° C. At this time, the finish rolling was performed such that a rolling reduction of each pass of rolling was 15%. The magnesium alloy plates obtained by the finish rolling were subjected to the heat treatment at 320° C. for 30 minutes. As a result, Samples were obtained. In accordance with the same method used in Test Example 2, measurement of an average crystal grain size, evaluation of a state of a plate surface and evaluation of edge cracking were performed to each sample. Casting conditions and conditions for the leveler and polishing after the rolling are the same as those for the material member A of Test Example 1. The same press molding performed in Test Example 1 and the same surface treatment performed in Example 1 were performed to the obtained samples and then an evaluation for the surface treatment states was performed.

The rough rolling conditions and results of the test are described in Table 12. In Table 12, "temperature of rough-rolling plate" means a surface temperature of a plate just before the rough rolling; "temperature of rolls for rough rolling" means a surface temperature of mill rolls for the rough rolling; and "(rolling reduction)/(pass of rolling) means (rolling reduction)/(pass of rolling) in rolling performed such that a thickness of a plate becomes from 4 mm to 1.0 mm.

TABLE 12

| Sample No. | Temperature of Rough-Rolling Plate (° C.) | Temperature of Rolls for Rough Rolling (° C.) | Rolling Reduction/ Pass of Rolling (%) | Surface State | Edge Cracking | Average Grain diameter (μm) |
|---|---|---|---|---|---|---|
| 6-1 | 300 | 180 | 20 | ○ | ○ | 4.9 |
| 6-2 | 300 | 200 | 20 | ○ | ○ | 5.0 |
| 6-3 | 300 | 250 | 20 | ○ | ○ | 4.8 |
| 6-4 | 320 | 180 | 20 | ○ | ○ | 4.8 |
| 6-5 | 320 | 200 | 20 | ○ | ○ | 4.9 |
| 6-6 | 350 | 200 | 20 | ○ | ○ | 4.6 |
| 6-7 | 350 | 250 | 20 | ○ | ○ | 4.7 |
| 6-8 | 380 | 180 | 20 | ○ | ○ | 4.5 |
| 6-9 | 380 | 250 | 20 | ○ | ○ | 4.6 |
| 6-10 | 380 | 250 | 30 | ○ | ○ | 4.4 |
| 6-11 | 380 | 300 | 30 | ○ | ○ | 4.4 |
| 6-12 | 380 | 300 | 35 | ○ | ○ | 4.2 |

As shown in Table 12, a rolled material having an excellent surface state can be obtained by controlling a temperature of a rough-rolling plate to 300 to 380° C. and controlling a temperature of mill rolls for the rough rolling 180 to 300° C. When a rolling reduction of each pass of rolling is in the range of 20 to 35% in the rough rolling, it is possible to reduce an average crystal grain size of a magnesium alloy plate subjected to the rough rolling and then finish rolling. In addition, in the case in which a material plate after the press molding is subjected to the surface-preparation treatment and the paint application treatment, the undercoating treatment and the overcoating treatment are each performed once, and the puttying and the polishing are not required.

Test Example 7

Next, by using twin roll cast materials of a magnesium alloy having a different content of Al from that of Test Example 6, evaluations about effects of a temperature of a plate, a temperature of rolls and the like at the time of rough rolling were performed. Plates of Test Example 7 includes 9.8% by mass of Al, 1.0% by mass of Zn, and other additional elements except for Al and Zn, which are permissive in AZ91. The balance includes Mg and unavoidable impurities. Producing conditions and evaluation methods of the magnesium alloy plates are the same as in Test Example 6, except for the chemical components of the magnesium alloys and the rough rolling conditions. The same press molding performed in Test Example 1 and the same surface treatment performed in Example 1 were performed to obtained samples and then an evaluation for the surface treatment states was performed. The rough rolling conditions and results of the test are described in Table 13.

TABLE 13

| Sample No. | Temperature of Rough-Rolling Plate (° C.) | Temperature of Rolls for Rough Rolling (° C.) | Rolling Reduction/ Pass of Rolling (%) | Surface State | Edge Cracking | Average Grain diameter (μm) |
|---|---|---|---|---|---|---|
| 7-1 | 300 | 180 | 20 | ○ | ○ | 4.9 |
| 7-2 | 300 | 250 | 20 | ○ | ○ | 4.8 |
| 7-3 | 320 | 200 | 20 | ○ | ○ | 4.9 |
| 7-4 | 350 | 250 | 20 | ○ | ○ | 4.7 |
| 7-5 | 380 | 300 | 30 | ○ | ○ | 4.4 |

As shown in Table 13, a rolled material having an excellent surface state can be obtained by controlling a temperature of a rough-rolled plate to 300 to 380° C. and controlling a temperature of mill rolls for the rough rolling to 180 to 300° C. When a rolling reduction of each pass of rolling is in the range of 20 to 30% in the rough rolling, it is possible to reduce an average crystal grain size of a magnesium alloy plate subjected to the rough rolling and then finish rolling. In addition, in the case in which a material plate after the press molding is subjected to the surface-preparation treatment and the paint application treatment, the undercoating treatment and the overcoating treatment are each performed once, and the puttying and the polishing are not required.

Test Example 8

Next, cast materials of AZ91 (thickness 4 mm) identical to the cast materials used in Test Example 6 were prepared. The cast materials were subjected to the rough rolling under different conditions such that a thickness of each material plate was reduced up to 1 mm. Thus, rough-rolled plates were obtained. The rough-rolled plates were subjected to the finish rolling under the same conditions such that a thickness of each finally obtained plate was reduced up to 0.5 mm. As a result, magnesium alloy plates were obtained.

In the rough rolling, a surface temperature of each plate just before the rough rolling was controlled to 350° C., and at that time, a surface temperature of mill rolls for the rough rolling was controlled in the range of 200 to 230° C. In addition, a rolling reduction of each pass of rolling was changed. In the finish rolling, a surface temperature of each rough-rolled plate just before the finish rolling was controlled to 210 to 240° C. and a surface temperature of mill rolls for the finish rolling was controlled to 150 to 180° C. In addition, a rolling reduction of each pass of rolling was 15%.

Next, the finish rolled materials were subjected to the heat treatment at 320° C. for 30 minutes as Test Example 1. As a result, samples were obtained. In accordance with the same method used in Test Example 6, a measurement of an average crystal grain size, evaluation of a state of a plate surface and evaluation of edge cracking were performed to each sample. In Test Example 8, an evaluation of a fluctuation in grain diameter was additionally performed. Evaluation criteria for the fluctuation in grain diameter are as follows:

L . . . (longest grain diameter)/(shortest grain diameter)≧2;

M . . . 2>(longest grain diameter)/(shortest grain diameter)≧1.5; and

S . . . (longest grain diameter)/(shortest grain diameter)<1.5

The same press molding performed in Test Example 1 and the same surface treatment performed in Example 1 were performed to the obtained samples and film-forming properties of the surface treatment layers were also evaluated.

The number of rolling in the rough rolling performed with a rolling reduction of each pass of rolling of 20 to 40% and evaluation results are described in Table 14. In Table 14, "number of rough rolling with rolling reduction of 20 to 40%" means the number of rough rolling in which a rolling reduction of single rough rolling was in the range of 20 to 40%, and "(maximum rolling reduction)/(pass of rolling)" means the maximum rolling reduction of each pass of rolling in the rough rolling performed in a multi-pass manner.

TABLE 14

| Sample No. | Number of Rough Rolling with Rolling Reduction of 20 to 40% | Maximum Rolling Reduction/Pass of Rolling (%) | Rolling Reduction/ Pass of Rolling (%) | Surface State | Edge Cracking | Fluctuation in grain diameter |
|---|---|---|---|---|---|---|
| 8-1 | 2 | 20 | ○ | ○ | 4.9 | S |
| 8-2 | 2 | 27 | ○ | ○ | 4.8 | S |
| 8-3 | 2 | 30 | ○ | ○ | 4.7 | S |
| 8-4 | 2 | 36 | ○ | ○ | 4.6 | S |
| 8-5 | 2 | 40 | ○ | ○ | 4.5 | S |
| 8-6 | 3 | 20 | ○ | ○ | 4.9 | S |
| 8-7 | 3 | 30 | ○ | ○ | 4.8 | S |
| 8-8 | 3 | 40 | ○ | ○ | 4.6 | S |
| 8-9 | 4 | 20 | ○ | ○ | 4.9 | S |
| 8-10 | 4 | 30 | ○ | ○ | 4.8 | S |
| 8-11 | 4 | 35 | ○ | ○ | 4.6 | S |
| 8-12 | 5 | 20 | ○ | ○ | 4.8 | S |
| 8-13 | 5 | 30 | ○ | ○ | 4.7 | S |
| 8-14 | 5 | 40 | ○ | ○ | 4.3 | S |
| 8-15 | 6 | 20 | ○ | ○ | 4.6 | S |

As shown in Table 14, when rolling performed with a rolling reduction of each pass of rolling of 20 to 40% is included in the rough rolling, nonuniformity in grain diameters of a magnesium alloy plate subjected to the rough rolling and then the finish rolling can be reduced. Accordingly, a rolled material having an excellent surface state can be obtained. In addition, in the case in which a material plate after the press molding is subjected to the surface-preparation treatment and the paint application treatment, the undercoating treatment and the overcoating treatment are each performed once, and the puttying and the polishing are not required.

Test Example 9

Next, by using twin roll cast materials of a magnesium alloy having a different content of Al from that of Test Example 8, evaluations about effects of a temperature of a material plate, a temperature of rolls and the like at the time of rough rolling were performed as Test Example 8. Producing conditions and evaluation methods of the magnesium alloy plate are the same as in Test Example 8, except for the chemical components of the cast materials. Plates of Test Example 9 includes 9.8% by mass of Al, 1.0% by mass of Zn, and other additional elements except for Al and Zn, which are permissive in AZ91. The balance includes Mg and unavoidable impurities. The rolling conditions and the results of the test are described in Table 15. The same press molding performed in Test Example 1 and the same surface treatment performed in Example 1 were performed to obtained samples and film-forming properties of the surface treatment layers were also evaluated.

TABLE 15

| Sample No. | Number of Rough Rolling with Rolling Reduction of 20 to 40% | Maximum Rolling Reduction/Pass of Rolling (%) | Rolling Reduction/ Pass of Rolling (%) | Surface State | Edge Cracking | Fluctuation in grain diameter |
|---|---|---|---|---|---|---|
| 9-1 | 2 | 20 | ○ | ○ | 4.9 | S |
| 9-2 | 2 | 28 | ○ | ○ | 4.8 | S |
| 9-3 | 2 | 38 | ○ | ○ | 4.5 | S |
| 9-4 | 3 | 20 | ○ | ○ | 4.9 | S |
| 9-5 | 4 | 20 | ○ | ○ | 4.9 | S |
| 9-6 | 5 | 20 | ○ | ○ | 4.9 | S |
| 9-7 | 5 | 30 | ○ | ○ | 4.7 | S |
| 9-8 | 5 | 38 | ○ | ○ | 4.4 | S |

As shown in Table 15, when a rolling reduction of each pass of rolling is in the range of 20 to 38% in the rough rolling, a fluctuation in grain diameter of a magnesium alloy plate subjected to the rough rolling and then the finish rolling can be reduced. Accordingly, a rolled material having an excellent surface state can be obtained. In addition, in the case in which a material plate after the press molding is subjected to the surface-preparation treatment and the paint application treatment, the undercoating treatment and the overcoating treatment are each performed once, and the puttying and the polishing are not required.

Summary of Test Examples 6 to 9

The conclusion from the results of Test Examples 6 to 9 is that a magnesium alloy plate in which a fluctuation in grain diameter is small and which has no problems including surface defects and edge cracking and has excellent plastic processability is obtained by performing the rough rolling under the appropriate conditions.

Test Example 10

Next, cast materials of a magnesium alloy (thickness 4.0 mm) having a composition of 9.0% by mass of Mg, 1.0% by mass of Al and Zn and a composition of 9.8% by mass of Mg, 1.0% by mass of Al and Zn were obtained by the twin roll-continuous casting as in the case of the material member A of Test Example 1. The maximum width of the center line segregation of each obtained cast material was 50 μm in a thickness direction of the plate. The caste materials were treated in accordance with the following three kinds of conditions and then rolled.

For the cast materials having a composition of 9.0% by mass of Mg, 1.0% by mass of Al and Zn Sample 10-1 . . . 405° C.×1 hour (solution treatment); and Sample 10-2 . . . 405° C.×10 hour (solution treatment)

For the cast materials having a composition of 9.8% by mass of Mg, 1.0% by mass of Al and Zn Sample 10-3 . . . 405° C.×1 hour (solution treatment); and Sample 10-4 . . . 405° C.×10 hour (solution treatment)

The magnesium alloy plates obtained by performing the above-mentioned treatments were rolled under the following conditions such that thicknesses of them were reduced up to 0.6 mm, respectively. Then, the magnesium alloy plates were subjected to the heat treatment under the appropriate conditions. As a result, plates having an average crystal grain size of 5.0 μm were obtained.

<Rough Rolling 4.0 mm to 1.0 mm>

Surface temperature of rolls: 200° C.;

Plate heating temperature: 330 to 360° C.; and

Rolling reduction of each pass of rolling: 20 to 25%.

<Finish Rolling 1.0 mm to 0.6 mm>

Surface temperature of rolls: 180° C.;

Plate heating temperature: 230° C.; and

Rolling reduction of each pass of rolling: 10 to 15%.

<Heat Treatment>

320° C.×30 minutes.

Next, samples for a tensile test regulated as JIS Z 2201 13B (1998) were sampled from these plates and then subjected to the tensile test at a strain rate of $1.4\times10^{-3}(s^{-1})$ under the condition of room temperature. In addition, alloy structures of plate cross-sections having a size of 0.6 mm were observed and then amounts of center line segregation (maximum width in a thickness direction) were measured, respectively. Test methods and meanings are as follows. Test results are described in Table 16.

Tensile strength=(load at the time of breaking)/(thickness× width of sample);

Yield strength=measured by 0.2% proof stress;

Yield ratio=(yield strength)/(tensile strength); and

Breaking elongation rate=(distance between gauge points at the time that cut ends are bonded each other−50 mm)/50 mm*1.

*1: a distance (50 mm) between two gauge points set before the test and a distance between the gouge points at the time that cut ends of a broken sample after the test are bonded each other are used to measure a breaking elongation rate.

That is, the breaking elongation rate is measured by a bonding method.

TABLE 16

| Sample No. | Center Line Segregation (μm) | Tensile Strength (MPa) | Yield Strength (MPa) | Breaking Elongation (%) | Yield Ratio (%) |
|---|---|---|---|---|---|
| 10-1 | 18 | 365 | 280 | 17 | 76.5 |
| 10-2 | 10 | 380 | 300 | 20 | 79.0 |
| 10-3 | 19 | 370 | 284 | 16 | 76.8 |
| 10-4 | 12 | 386 | 305 | 20 | 79.0 |

As shown in Table 16, it was confirmed that a width in a thickness direction of center line segregation is reduced by performing the solution treatment to a cast material produced by the twin roll-continuous casting and as a result, a magnesium alloy plate having excellent mechanical properties can be obtained. Particularly, in the case of a magnesium alloy including a large amount of Al, including a magnesium alloy corresponding to AZ91, it is subjected to the solution treatment for a long period of time. As a result, a magnesium alloy plate having more excellent mechanical properties can be obtained.

In addition, the same press molding performed in Test Example 1 and the same surface treatment performed in Example 1 were performed to each obtained rolled materials and then an evaluation for the film-forming states of surface treatment layers was performed. As a result, it was found that in the case in which the samples are subjected to the surface-preparation treatment and the paint application treatment, the undercoating treatment and the overcoating treatment are each performed once, and the puttying and the polishing are not required.

Test Example 11

Cast materials of a magnesium alloy (thickness 4.0 mm) having a composition of 9.0% by mass of Mg, 1.0% by mass of Al and Zn and a composition of 9.8% by mass of Mg, 1.0% by mass of Al and Zn were obtained by the twin roll-continuous casting. The cast materials were subjected to the solution treatment at 405° C. for 10 hours and then magnesium alloy materials were obtained. The magnesium alloy materials were rolled under the following conditions such that thicknesses of the magnesium alloy materials were reduced up to 0.6 mm, respectively. Thus, magnesium alloy plates were obtained. The maximum size of the center line segregation in a thickness direction of each magnesium alloy plate was 20 μm.

<Rough Rolling 4.00 mm to 1.0 mm>

Surface temperature of rolls: 200° C.;

Plate heating temperature: 330 to 360° C.; and

Rolling reduction of each pass of rolling: 20 to 25%.

<Finish Rolling 1.0 mm to 0.6 mm>

Surface temperature of rolls: 180° C.;

Plate heating temperature: 230° C.; and

Rolling reduction of each pass of rolling: 10 to 15%.

The magnesium alloy plates rolled and obtained under the above-mentioned conditions were subjected to the heat treatment at 320° C. for 30 minutes. Thus, plates for an evaluation were obtained.

Next, samples for a tensile test regulated as JIS Z 2201 13B (1998) were sampled from these plates and then subjected to the tensile test at a strain rate of $1.4\times10^{-3}(s^{-1})$ under the three temperature conditions (room temperature (25° C.), 200° C. and 250° C.). In addition, alloy structures of plate cross-sections having a size of 0.6 mm before and after the tensile test were observed, respectively. Test methods and meanings of terms are identical to those of Test Example 10. Test results are described in Table 17. Samples No. 11-1 to 11-3 indicate test results of the magnesium alloy plates having a composition of 9.0% by mass of Mg, 1.0% by mass of Al and Zn and samples No. 11-4 to 11-6 indicate test results of the magnesium alloy plates having a composition of 9.8% by mass of Mg, 1.0% by mass of Al and Zn.

TABLE 17

| Sample No. | Heat Treatment After Rolling | Metal Structure | Test Temperature | Tensile Strength (MPa) | Yield Strength (MPa) | Breaking Elongation (%) |
|---|---|---|---|---|---|---|
| 11-1 | 320° C. 30 minutes | Complete Recrystallization | 25° C. | 365 | 280 | 16~18 |
| 11-2 | 320° C. 30 minutes | Complete Recrystallization | 200° C. | 140 | 130 | 80~86 |
| 11-3 | 320° C. 30 minutes | Complete Recrystallization | 250° C. | 90 | 80 | 100~110 |
| 11-4 | 320° C. 30 minutes | Complete Recrystallization | 25° C. | 368 | 285 | 16~19 |
| 11-5 | 320° C. 30 minutes | Complete Recrystallization | 200° C. | 145 | 129 | 84~90 |
| 11-6 | 320° C. 30 minutes | Complete Recrystallization | 250° C. | 92 | 80 | 105~114 |

As shown in Table 17, in the plates subjected to the heat treatment at 320° C. for 30 minutes, strains occurring by the rolling and accumulated in the magnesium alloy plates were eliminated and recrystallization was completely performed. In each plate in which recrystallization was completely performed due to the heat treatment, crystal particles of a structure of the plate did not become coarse and a difference of average crystal grain size before and after the process was rarely made even if a temperature increases (250° C. or less) in performing stretching. Accordingly, it is inferable that a portion of the plate deformed in performing stretching has processing strain and is improved in hardness and strength and a portion of the plate undeformed in performing the stretching has no change in hardness and strength. The plates subjected to the heat treatment at 320° C. for 30 minutes were high in the tensile strength, yield strength and breaking elongation rate at room temperature, and were stably high in the breaking elongation rate at 200° C. and 250° C.

The above-described results show that there is little change in the completely recrystallized metal structure of the plate before and after a process. Accordingly, the plate has stable plastic processability. In addition, it is inferable that mechanical properties of a portion deformed by a process are improved and mechanical properties of an undeformed portion are maintained. Therefore, even if the plate in which processing strain accumulated in rolling is released is subjected to an intensive process such as press molding, the plate has stable mechanical properties. Accordingly, the plate is suitable for housing which are manufactured by the press molding.

Then, the obtained heat-treated materials were subjected to the same press molding performed in Test Example 1 and the same surface treatment performed in Example 1 and then an evaluation for film-forming states of surface treatment layers was performed. As a result, it was found that in the case in which the samples are subjected to the surface-preparation treatment and the paint application treatment, the undercoating treatment and the overcoating treatment are each performed once, and the puttying and the polishing are not required.

Test Example 12

Next, the casting, rough rolling and finish rolling were performed under the conditions described in Test Example 11 to produce magnesium alloy plates having a thickness of 0.6 mm (having a composition of 9.0% by mass of Mg, 1.0% by mass of Al and Zn and a composition of 9.8% by mass of Mg, 1.0% by mass of Al and Zn). Then, the magnesium alloy plates after the finish rolling were subjected to the heat treatment at 320° C. for 30 minutes, and thus samples for an evaluation were produced. A bending test was performed to these samples. In the bending test, each sample was supported at two points and then a force was applied in a direction opposite to the support points by a tool for bending and forming (punch), such that the sample was bended. That is, a three-point bending test was used as the bending test. Conditions for the bending test are as follows.

<Conditions for Test>

Sample size . . . width 20 mm, length 120 mm, thickness 0.6 mm;

Test temperature . . . 200° C., 250° C.;

Tip end angle of punch . . . 30°;

Punch radius (=bending radius of sample) . . . 0.5 mm;

distance between points . . . 30 mm;

Insertion depth of punch . . . 40 mm; and

Insertion speed of punch (processing speed) . . . 1.0 m/min, 5.0 m/min.

By performing the test under the above-mentioned conditions, a surface state in a bending radius portion of each sample and an amount of spring-back were observed. Spring-back is a phenomenon in which deformation in a plate-shaped sample, caused by a force applied by a punch, returns to normal after the force applied by the punch is removed. That is, when an amount of spring-back of the sample is large, it is determined that deformability is low and when the amount of spring-back of the sample is small, it is determined that deformability is high. Therefore, it is possible to determine processability of the sample by measuring the amount of spring-back. "O" means the surface has no cracks. The amount of spring-back is obtained by an expression of (angle formed by sample surfaces in bending radius when force is applied to sample by punch)−(angle formed by sample surfaces in bending radius when force is removed). "S" means that a difference between the angles is less than 10°.

As an indicator indicating a processing degree, a bending characteristic value was provided. The bending characteristic is expressed by an expression of (bending radius of sample (mm))/(thickness of sample (mm)). As the bending radius of the sample is smaller, a pressure is locally applied to the bending radius. Accordingly, damages such as cracks are easily generated in the sample. In addition, as the thicker the thickness of the sample is, the lower the moldability of the sample is. Thus, damages such as cracks are also easily generated. Therefore, if the bending characteristic value expressed by the above expression is smaller, it means that an intensive process having complicated process conditions is required.

Results of the above-described surface state, spring-back and bending characteristic value are described in Table 18. Samples No. 12-1 to 12-4 indicate test results of the magnesium alloy plates having a composition of 9.0% by mass of Mg, 1.0% by mass of Al and Zn and samples No. 12-5 to 12-8 indicate test results of the magnesium alloy plates having a composition of 9.8% by mass of Mg, 1.0% by mass of Al and Zn.

TABLE 18

| Sample No. | Test Temperature | Bending Radius (mm) | Processing Speed (m/min) | Radius/ Thickness | Spring-back | Surface State |
|---|---|---|---|---|---|---|
| 12-1 | 200° C. | 0.5 | 1.0 | 0.83 | S | ○ |
| 12-2 | 200° C. | 0.5 | 5.0 | 0.83 | S | ○ |
| 12-3 | 250° C. | 0.5 | 1.0 | 0.83 | S | ○ |
| 12-4 | 250° C. | 0.5 | 5.0 | 0.83 | S | ○ |
| 12-5 | 200° C. | 0.5 | 1.0 | 0.83 | S | ○ |
| 12-6 | 200° C. | 0.5 | 5.0 | 0.83 | S | ○ |
| 12-7 | 250° C. | 0.5 | 1.0 | 0.83 | S | ○ |
| 12-8 | 250° C. | 0.5 | 5.0 | 0.83 | S | ○ |

When the test temperature is 200° C. or more, the amounts of spring-back were small and the surface states were good in the samples having a composition of 9.0% by mass of Mg, 1.0% by mass of Al and Zn and the samples having a composition of 9.8% by mass of Mg, 1.0% by mass of Al and Zn, respectively. It was found that the moldability is good when the bending process is performed at a temperature of 200° C. or more.

The samples after the bending process were subjected to the same surface treatment performed in Example 1 and then film-forming properties of surface treatment layers were also evaluated. As a result, it was found that the undercoating treatment and the overcoating treatment are each performed once, but the puttying and the polishing are not required when the surface-preparation treatment and the paint application treatment are performed to a bending-processed material.

Test Example 13

Next, the casting, rough rolling and finish rolling were performed under the conditions described in Test Examples 11 and 12 to produce magnesium alloy plates having a thickness of 0.6 mm (having a composition of 9.0% by mass of Mg, 1.0% by mass of Al and Zn and a composition of 9.8% by mass of Mg, 1.0% by mass of Al and Zn). Then, the magnesium alloy plates were subjected to the heat treatment at 320° C. for 30 minutes, and thus samples for an evaluation were produced. A pressing test was performed to these samples and surface states of the samples to which pressing was performed were observed.

The samples were pressed by a servo press machine. Pressing was performed in a manner that the sample was disposed on a rectangular lower portion having a depression so as to cover the depression and then the sample was pressed against a rectangular upper portion. The upper portion has a rectangular shape having a size of 60 mm×90 mm, and 4 corners thereof, which abut on the sample, are rounded. Each corner has a given bending radius. The upper and lower portions have a heater and a thermocouple, respectively. Accordingly, it is possible to adjust a temperature at the time of pressing to a desired temperature when pressing is performed.

<Test Conditions>

Bending radius of upper portion . . . 0.5 mm;

Test temperature . . . 200° C., 250° C.; and

Processing speed . . . 0.8 m/min, 1.7 m/min, 3.4 m/min, 5.0 m/min

Under the above-mentioned conditions, press molding was performed and then the surface states of the bending radius portions of the samples were observed. The results are described in Table 19. Samples No. 13-1 to 13-4 indicate test results of the magnesium alloy plates having a composition of 9.0% by mass of Mg, 1.0% by mass of Al and Zn and samples No. 13-5 to 13-8 indicate test results of the magnesium alloy plates having a composition of 9.8% by mass of Mg, 1.0% by mass of Al and Zn. The meanings of the surface state is identical with that used in Test Example 12. A bending characteristic value of each sample was obtained by an expression of (bending radius of upper portion)/(thickness of sample).

In the case in which the samples having a composition of 9.0% by mass of Mg, 1.0% by mass of Al and Zn had a temperature of 200° C. at the time of pressing, the surface states of the samples were good when the processing speed was low (sample No. 13-1). In addition, in which the samples having a composition of 9.0% by mass of Mg, 1.0% by mass of Al and Zn had a temperature of 250° C. at the time of pressing, the surface states of the samples were also good even when the processing speed was high. In the case in which the sampled having a composition of 9.8% by mass of Mg, 1.0% by mass of Al and Zn had a high temperature at the time of press molding, the surface stated of the sampled were good even when the processing speed was high. It is clear that in the case in which the magnesium alloy plate subjected to the heat treatment is subjected to the press molding at a temperature of 250° C., press moldability is good even when an intensive process (bending characteristic value 0.83) is performed at a processing speed of 5.0 m/min.

The obtained press-formed plates were subjected to the same surface treatment performed in Example 1. As a result, it was found that the undercoating treatment and the overcoat treatment are each performed once, but the puttying and the polishing are not required when the surface-preparation treatment and the coating treatmentpaint application treatment are performed to the press-formed plates.

Summary of Test Examples 11 to 13

From the results of Test Examples 11 to 13, it was found that the magnesium alloy plate after the rolling is subjected to the heat treatment at an appropriate temperature to recrystallize the structure of the alloy plate, and thus moldability becomes stable. The reason of stability in moldability is that since the metal structure is recrystallized before the plasticity process (including press molding), the metal structure rarely varies even if a temperature increases in the plasticity process.

Test Example 14

Next, material plates of AZ91, subjected to the casting and rolling, were prepared. Then, a material plate, a press-formed plate in which the material plate was subjected to the press molding and a coated plate in which the material plate was subjected to the press molding, surface-preparation treatment and paint application treatment were used as samples. The average crystal grain size, tensile strength, 0.2% proof stress

TABLE 19

| Sample No. | Heat Treatment After Rolling | Test Temperature | Bending Radium (mm) | Processing Speed (m/min) | Bending Characteristic Value | Surface State |
|---|---|---|---|---|---|---|
| 13-1 | 320° C. 30 minutes | 200° C. | 0.5 | 0.8 | 0.83 | ○ |
| 13-2 | 320° C. 30 minutes | 250° C. | 0.5 | 1.7 | 0.83 | ○ |
| 13-3 | 320° C. 30 minutes | 250° C. | 0.5 | 3.4 | 0.83 | ○ |
| 13-4 | 320° C. 30 minutes | 250° C. | 0.5 | 5.0 | 0.83 | ○ |
| 13-5 | 320° C. 30 minutes | 200° C. | 0.5 | 0.8 | 0.83 | ○ |
| 13-6 | 320° C. 30 minutes | 250° C. | 0.5 | 1.7 | 0.83 | ○ |
| 13-7 | 320° C. 30 minutes | 250° C. | 0.5 | 3.4 | 0.83 | ○ |
| 13-8 | 320° C. 30 minutes | 250° C. | 0.5 | 5.0 | 0.83 | ○ |

(yield strength) and elongation rate of each sample were evaluated. The surface portion and the center portion of the material plate are cut by a cutting method according to JIS G 0551 (2005) and then grain diameters of the portions are measured. The average value of diameters is used as the average crystal grain size. Herein, the press-formed plate and the coated plate are cases for a demonstration PDA. The average crystal grain sizes of the flat portion to which the bending process is not performed and the R portion to which the bending process of the molded plate (coated plate) are measured. A test piece is sampled from the flat portion of the material plate, press-formed plate or the coated plate according to JIS Z 2201 13B (1998) and then the test piece is subjected to the tensile test to obtain the tensile strength, 0.2% proof stress and elongation rate.

For the test piece, the rolling conditions described in Table 2 of Test Example 1 and the heat treatment conditions after the finish rolling were changed as follows and other casting conditions, rolling conditions and pressing conditions were identical to those for the material member A of Test Example 1.

Rolling reduction of each pass of rolling in rough rolling: 20 to 30%;

Surface temperature of rolls for finish rolling: 180° C.;

Heat treatment after finish rolling;

Sample 14-1: 340° C.×30 minutes;

Sample 14-2: 360° C.×30 minutes; and

Sample 14-3: 380° C.×30 minutes.

Moreover, the surface-preparation treatment conditions, paint application treatment conditions were identical to those of Example 1 described in Test Example 1. Test results are described in Table 20.

TABLE 20

| | | Material Plate | | | | Press-formed Plate | | | | Coated Plate | | | |
|---|---|---|---|---|---|---|---|---|---|---|---|---|---|
| | | GS (μm) | TS (MPa) | YP (MPa) | EL (%) | GS (μm) | TS (MPa) | YP (MPa) | EL (%) | GS (μm) | TS (MPa) | YP (MPa) | EL (%) |
| Sample 14-1 | Flat Portion | 6.1 | 345 | 245 | 12 | 6.2 | 344 | 244 | 11 | 6.1 | 346 | 245 | 12 |
| | R Portion | — | — | — | — | 6.0 | — | — | — | 5.9 | — | — | — |
| Sample 14-2 | Flat Portion | 7.9 | 336 | 241 | 11 | 7.8 | 337 | 245 | 10 | 8.0 | 335 | 241 | 11 |
| | R Portion | — | — | — | — | 7.6 | — | — | — | 7.8 | — | — | — |
| Sample 14-3 | Flat Portion | 10.1 | 326 | 240 | 10 | 10.0 | 337 | 256 | 11 | 10.2 | 337 | 254 | 10 |
| | R Portion | — | — | — | — | 9.8 | — | — | — | 9.8 | — | — | — |

GS indicates an average crystal grain size, TS indicates a tensile strength, YP indicates a 0.2% proof stress, and EL indicates an elongation rate.

As shown in Table 20, it was found that the material plate, molded plate and coated plate had little change in the average crystal grain size, tensile strength, 0.2% proof stress and elongation rate. Further, it was found that the average crystal grain size of the R portion subjected to the bending process was slightly smaller than that of the flat portion.

Test Example 15

Figure 1B:
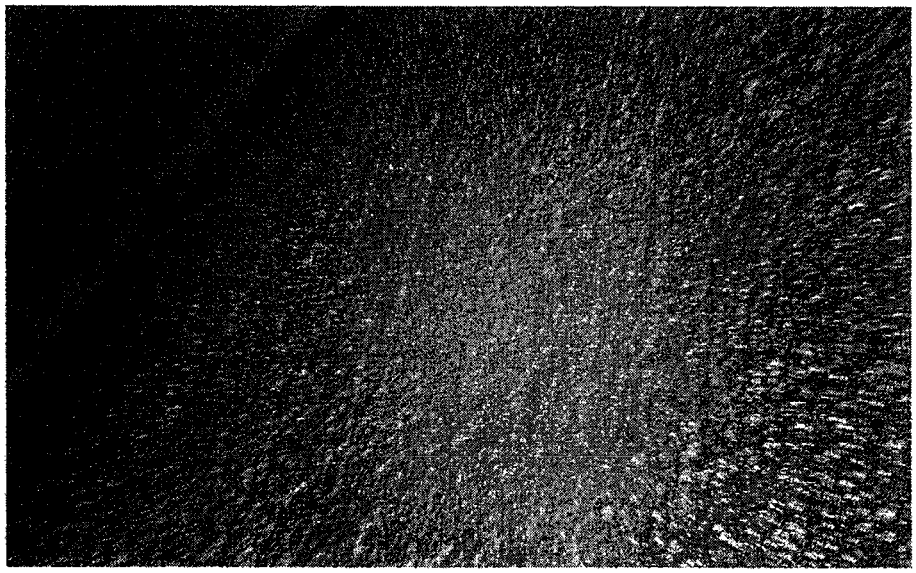
FIG. 1*b* shows a corner R portion of a microimage of an anticorrosive film on the magnesium alloy member related to Example 15.

A plate of AZ91 subjected to the twin roll-continuous casting, warm-rolling, leveling process, and polishing in Process 1 of Test Example 1 was used as a treating base material. As the surface-preparation treatment, the chemical treatment was performed by stirring the treating base material and the same treatment solution used in Example 1 at 40° C. for 2 minutes. The base material subjected to the chemical treatment was subjected to the same pressing process performed in Example 1. The surface of the case for a demonstration PDA after the pressing process was observed by a microscope. The observed results are shown in FIG. 1. From the results, it was found that the flat portion (FIG. 1(*a*)) and the R portion (FIG. 1(*b*)) after the pressing process has no crack and loss in the chemical conversion treatment film and the chemical conversion treatment film is uniformly formed. The test results of the surface resistance value and the adhesion of the chemical conversion treatment film were 0.1 Ω·cm and 100/100, respectively. In addition, the same paint application treatment performed in Test Example 1 was performed to the pressed product. That is, in Test Example 15, the twin roll-continuous casting, warm-rolling, leveling process, polishing, chemical treatment, cutting, pressing process and paint application treatment are performed. The test result of the adhesion of the painting film was 100/100 and the test result of the corrosion resistance, that is, the ratio of the corroded area was 1% or less. From the results, it was found that the magnesium alloy member subjected to the anticorrosion treatment before the pressing process and subjected to the paint application treatment after the pressing process has the same performance as one to which the pressing process, anticorrosion treatment and paint application treatment are sequentially performed.

Test Example 16

In Process 1 described in Test Example 1, a metallic colloid solution described in JP-A-2005-248204 are mixed into a coating composition for overcoating for the paint application treatment (manufactured by Kanpe Hapio Co., Ltd, black acrylic lacquer spray A). The mixed coating composition is used for performing the overcoating treatment. The metallic colloid solution is produced as follows.

24 g of silver nitrate was dissolved in 150 g of pure water. Then, ammonia water was added to adjust pH of the mixture to 11.0. As a result, a silver nitrate ammonia solution was prepared. Next, 12 g of polyvinylpyrrolidone (molecular weight: 30,000) as a dispersant was added to the silver nitrate ammonia solution and dissolved. 100 g of ethylene glycol as a reducing agent was added and stirred at a stirring speed of 1,000 rpm for reaction at 40° C. for 180 minutes. As a result, a yellow water-based silver colloid solution having plasmon absorption was obtained.

Next, 20,000 g of the obtained silver colloid solution was centrifugalized for 20 minutes and a process of removing impurities lighter than silver particles was repeated. The separated silver particles were cleaned with water. Then, particle size distribution of the silver particles were measured by using a particle-size distribution analyzer (manufactured by NIKKISO CO., LTD., brand name: Microtrac UPA150EX) utilizing a laser Doppler method. As a result of the measurement, a sharp peak can be recognized at a point of 5 nm.

Next, The silver colloid solution was concentrated by using a rotary evaporator and the water content was reduced up to 20%. Acetone as a water-soluble organic solvent was added to produce a silver colloid solution including a mixed solvent of water and acetone. In this silver colloid solution, a compounding ratio of silver particles (Ag), water (W) and acetone (Ac) was 80:20:100 (Ag:W:Ac), based on a weight ratio.

10 parts by weight of this silver colloid solution and 20 parts by weight of the coating composition for overcoating were mixed to produce a mixed coating composition. The undercoating treatment was performed using the mixed coating composition and then the overcoating treatment was performed. The undercoating treatment and the overcoating treatment are each performed once, but the puttying the polishing were not performed.

When such a paint application treatment is performed, an overcoat layer including silver particles which are antibacterial metal particles can be formed as an uppermost layer. Accordingly, it is expected that the painting film has an antibacterial property.

INDUSTRIAL APPLICABILITY

A magnesium alloy member of the invention is expected to be used for a variety of fields requiring corrosion resistance, mechanical properties and surface quality. Specifically, the magnesium alloy member can be suitably used for housing for cellular phones, PDAs, notebook computers, or LCD or PDP televisions or parts of transport machines.

The invention claimed is:

1. A magnesium alloy member comprising:

a base material made of a magnesium alloy; and an anticorrosive film formed on the base material, wherein the base material is a rolled magnesium alloy comprising 5 to 11% by mass of Al, and the magnesium alloy having a surface defect satisfies the following requirements:

(1) an average crystal grain size is less than 20 μm;

(2) intermetallic compounds have a size of 20 μm or less; and (3) depth of the surface defect is 10% or less of a thickness of the base material, and length of the surface defect of the base material is 20 μm or less.

2. The magnesium alloy member according to claim 1, wherein the magnesium alloy member has a shear-processed portion.

3. The magnesium alloy member according to claim 2, wherein the magnesium alloy member comprises a plasticity-processed portion.

4. The magnesium alloy member according to claim 3, wherein the plasticity-processed portion is molded by a pressing process.

5. The magnesium alloy member according to claim 3, wherein the plasticity-processed portion is molded by at least one of a deep-drawing process, a forging process, a blowing process, and a bending process.

6. The magnesium alloy member according to claim 1, wherein the anticorrosive film is a chemical conversion treatment film.

7. The magnesium alloy member according to claim 1, wherein the anticorrosive film is an anodic oxidation film.

8. The magnesium alloy member according to claim 1, wherein a content of Cr in the anticorrosive film is 0.1% by mass or less.

9. The magnesium alloy member according to claim 1, wherein a content of Mn in the anticorrosive film is 0.1% by mass or less.

10. The magnesium alloy member according to claim 1, wherein the anticorrosive film is a phosphate film.

11. The magnesium alloy member according to claim 1, wherein a ratio of a corroded area to the entire area of the anticorrosive film after a 24-hour salt spray test (JIS Z 2371) is 1% or less and electrical resistance of the anticorrosive film measured by a two-probe method is 0.2 Ω·cm or less.

12. The magnesium alloy member according to claim 1, wherein a painting film is formed on the anticorrosive film.

13. The magnesium alloy member according to claim 12, wherein the painting film comprises an undercoat layer and an overcoat layer, the painting film does not include a putty for compensating for surface defects of the undercoat layer.

14. The magnesium alloy member according to claim 1, further comprising an antibacterial film as an uppermost layer, wherein the antibacterial film includes antibacterial fine metal particulates.

15. The magnesium alloy member according to claim 14, wherein the antibacterial film is the painting film formed on the anticorrosive film.

16. The magnesium alloy member according to claim 14, wherein the antibacterial fine metal particulates are formed of nickel, copper, silver, gold, platinum, palladium, or an alloy containing two or more of these metals.

17. The magnesium alloy member according to claim 1, wherein the magnesium alloy member has a tensile strength of 280 MPa or more, and a 0.2% proof stress of 200 MPa or more.

18. The magnesium alloy member according to claim 1, which is used as a chassis of an electronic equipment.

19. A method of manufacturing a magnesium alloy member, the method comprising:

preparing a material member formed of a rolled magnesium alloy including 5 to 11% by mass of Al; and performing an anticorrosion treatment to the material member to form an anticorrosive film on the material member, wherein the magnesium alloy having a surface defect satisfies the following requirements:

(1) an average crystal grain size is less than 20 μm;

(2) intermetallic compounds have a size of 20 μm or less; and (3) depth of the surface defect is 10% or less of a thickness of the material member, and length of the surface defect of the material member is 20 μm or less.

20. The method of manufacturing a magnesium alloy member according to claim 19, further comprising a step of performing a shearing process to the material member before performing the anticorrosion treatment.

21. The method of manufacturing a magnesium alloy member according to claim 20, further comprising a step of performing a plasticity process to the sheared material member after the step of performing the shearing process and before the step of performing the anticorrosion treatment.

22. The method of manufacturing a magnesium alloy member according to claim 19, further comprising a step of performing a shearing process to the anticorrosion-treated material member.

23. The method of manufacturing a magnesium alloy member according to claim 22, further comprising a step of performing a plasticity process to the sheared material member.

24. The method of manufacturing a magnesium alloy member according to claim 23, further comprising a step of performing a paint application treatment to the plasticized material member.

25. The method of manufacturing a magnesium alloy member according to claim 22, further comprising a step of performing a paint application treatment to the sheared material member.

26. The method of manufacturing a magnesium alloy member according to claim 25, wherein the paint application treatment includes an undercoating treatment and an overcoating treatment and the undercoating and overcoating treatments are each performed once.

27. The method of manufacturing a magnesium alloy member according to claim 19, further comprising a step of performing a paint application treatment to the anticorrosion-treated material member.

28. The method of manufacturing a magnesium alloy member according to claim 19, wherein the step of preparing a material member includes a step of obtaining a cast material including 5 to 11% by mass of Al and a step of warm-rolling the cast material.

29. The method of manufacturing a magnesium alloy member according to claim 28, wherein the step of obtaining a cast material is performed by rapid cooling solidification casting at a cooling rate of 50 K/sec or more.

30. The method of manufacturing a magnesium alloy member according to claim 29, wherein the rapid cooling solidification casting is twin roll casting.

* * * * *